US012344434B2

(12) United States Patent
Asensio Cotillas et al.

(10) Patent No.: US 12,344,434 B2
(45) Date of Patent: Jul. 1, 2025

(54) COLLAPSIBLE CONTAINER AND METHOD OF OPERATING A COLLAPSIBLE CONTAINER

(71) Applicant: CABKA Group GmbH, Berlin (DE)

(72) Inventors: Luis Asensio Cotillas, Valencia (ES); Guillermo Santamans Pons, Riba-roja de Turia (ES)

(73) Assignee: CABKA Group GmbH, Berlin (DE)

( * ) Notice: Subject to any disclaimer, the term of this patent is extended or adjusted under 35 U.S.C. 154(b) by 139 days.

(21) Appl. No.: 18/036,429

(22) PCT Filed: Nov. 10, 2021

(86) PCT No.: PCT/IB2021/060397
§ 371 (c)(1),
(2) Date: May 11, 2023

(87) PCT Pub. No.: WO2022/101796
PCT Pub. Date: May 19, 2022

(65) Prior Publication Data

US 2024/0017880 A1 Jan. 18, 2024

Related U.S. Application Data

(60) Provisional application No. 63/112,233, filed on Nov. 11, 2020.

(51) Int. Cl.
*B65D 19/06* (2006.01)
*B65D 19/40* (2006.01)
(Continued)

(52) U.S. Cl.
CPC ..... *B65D 19/06* (2013.01); *B65D 19/40* (2013.01); *B65D 21/0217* (2013.01);
(Continued)

(58) Field of Classification Search
CPC .... B65D 19/18; B65D 21/0226; B65D 1/225; B65D 7/24; B65D 9/12; B65D 9/22; B65D 19/16; B65D 19/12
(Continued)

(56) References Cited

U.S. PATENT DOCUMENTS 3,374,915 A 3/1968 Verhein et al.
4,673,087 A * 6/1987 Webb ..... B65D 11/1873 206/508
(Continued)

FOREIGN PATENT DOCUMENTS

CN 209396185 9/2019
DE 102004010237 9/2005
(Continued)

OTHER PUBLICATIONS

International Preliminary Report on Patentability May 25, 2023 From the International Bureau of WIPO Re. Application No. PCT IB2021/060397. (10 Pages).
(Continued)

*Primary Examiner* — Jeffrey R Allen

(57) ABSTRACT

A collapsible container comprising a base comprising a plurality of grooves located at a periphery of a top surface of said base; a first sleeve having a first set of three flat surfaces; wherein at least one first flat surface of said first set of three flat surfaces comprises an extension of said first flat surface adapted to be inserted in at least one groove of said plurality of grooves; a second sleeve having a second set of three flat surfaces; wherein at least one second flat surface of said second set of three flat surfaces comprises an extension of said second flat surface adapted to be inserted in at least one groove of said plurality of grooves; where when said first sleeve and said second sleeve are located in their respective grooves, they completely surround said base;
(Continued)

where said plurality of grooves do not comprise a full-angled groove.

20 Claims, 29 Drawing Sheets

(51) Int. Cl.
*B65D 21/02* (2006.01)
*B65D 21/08* (2006.01)
*B65D 65/38* (2006.01)

(52) U.S. Cl.
CPC ..... *B65D 21/0226* (2013.01); *B65D 21/086* (2013.01); *B65D 65/38* (2013.01); *B65D 2313/02* (2013.01); *B65D 2519/00129* (2013.01); *B65D 2519/00273* (2013.01); *B65D 2519/00288* (2013.01); *B65D 2519/00323* (2013.01); *B65D 2519/00338* (2013.01); *B65D 2519/00437* (2013.01); *B65D 2519/00502* (2013.01); *B65D 2519/00567* (2013.01); *B65D 2519/00587* (2013.01); *B65D 2519/00651* (2013.01); *B65D 2519/00711* (2013.01); *B65D 2519/00741* (2013.01); *B65D 2519/00875* (2013.01); *B65D 2519/0096* (2013.01); *B65D 2519/00975* (2013.01); *B65D 2565/384* (2013.01)

(58) Field of Classification Search
USPC ..... 220/4.28; 206/600
See application file for complete search history.

(56) References Cited

U.S. PATENT DOCUMENTS

| | | | | |
|---|---|---|---|---|
| 5,109,985 | A | | 5/1992 | Rose |
| 5,279,423 | A | | 1/1994 | Shuert |
| 5,538,178 | A | | 7/1996 | Zink et al. |
| 5,722,328 | A | | 3/1998 | Darby |
| 5,829,595 | A | * | 11/1998 | Brown ..... B65D 19/0018 206/386 |
| 5,908,135 | A | | 6/1999 | Bradford et al. |
| 6,024,223 | A | | 2/2000 | Ritter |
| 6,902,061 | B1 | | 6/2005 | Elstone |
| 8,112,859 | B2 | | 2/2012 | Vroon |
| 8,146,224 | B1 | | 4/2012 | Vroon |
| 8,523,004 | B2 | | 9/2013 | Vroon |
| 9,487,329 | B2 | | 11/2016 | Balazs et al. |
| 9,764,876 | B2 | | 9/2017 | Balazs et al. |
| 10,442,567 | B2 | | 10/2019 | Tattam |
| 2007/0251857 | A1 | | 11/2007 | Watanabc |
| 2011/0132801 | A1 | | 6/2011 | Elder |
| 2014/0197168 | A1 | | 7/2014 | Miller et al. |
| 2014/0284247 | A1 | | 9/2014 | Balazs et al. |
| 2016/0194110 | A1 | | 7/2016 | Balazs et al. |

FOREIGN PATENT DOCUMENTS

| | | |
|---|---|---|
| DE | 102005031526 | 4/2007 |
| DE | 202018107308 | 4/2019 |
| DE | 102019116227 | 9/2020 |
| EP | 0071467 | 2/1983 |
| EP | 2256051 | 12/2010 |
| EP | 2783996 | 10/2014 |
| EP | 3170762 | 5/2017 |
| GB | 2317878 | 4/1998 |
| GB | 2440327 | 1/2008 |
| JP | 2004-043031 | 2/2004 |
| JP | 2008-247453 | 10/2008 |
| JP | 2008-308194 | 12/2008 |
| JP | 2009-107703 | 5/2009 |
| JP | 5070968 | 8/2012 |
| WO | WO 2022/101796 | 5/2022 |

OTHER PUBLICATIONS

International Search Report and the Written Opinion Dated Feb. 3, 2022 From the International Searching Authority Re. Application No. PCT/IB2021/060397. (19 Pages).

* cited by examiner

Figure 8a
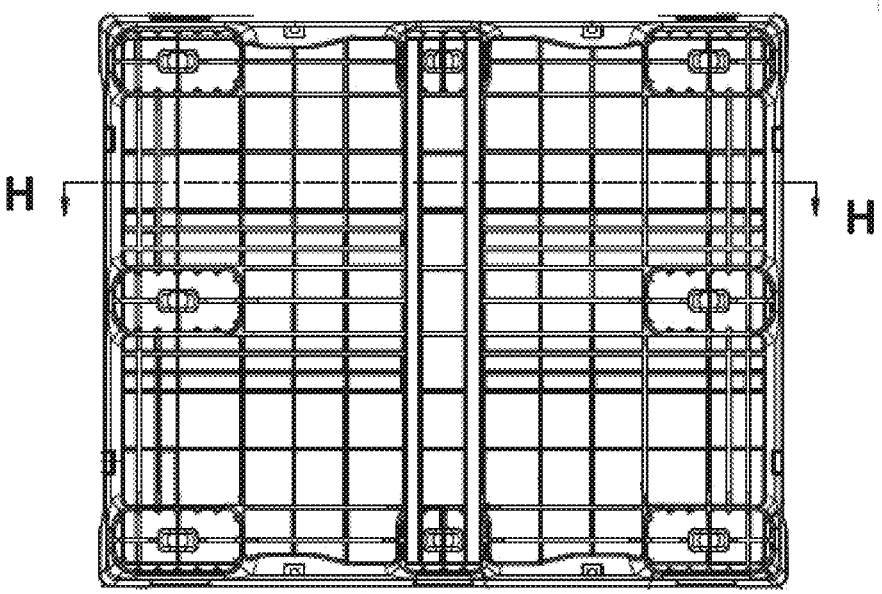
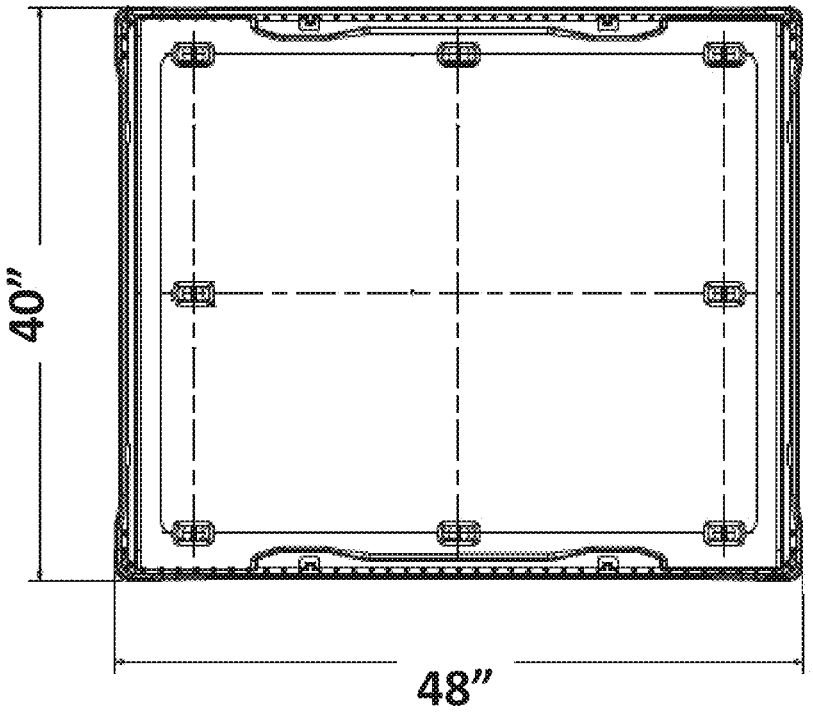
Figure 8b

2502

2502

COLLAPSIBLE CONTAINER AND METHOD OF OPERATING A COLLAPSIBLE CONTAINER

RELATED APPLICATION/S

This application is a National Phase of PCT Patent Application No. PCT/IB2021/060397 having International filing date of Nov. 10, 2021, which claims the benefit of priority under 35 USC § 119 (e) of U.S. Provisional Patent Application No. 63/112,233 filed on Nov. 11, 2020. The contents of the above applications are all incorporated by reference as if fully set forth herein in their entirety.

FIELD AND BACKGROUND OF THE INVENTION

The present invention, in some embodiments thereof, relates to a base for transporting goods comprising a sleeve and, more particularly, but not exclusively, to a base for transporting goods comprising a foldable sleeve.

Returnable bulk containers come in two general classifications: sleeve packs and knock downs. A sleeve pack includes a pallet or a base, a sleeve and a top cap. Sleeve packs are the most commonly used returnable bulk container in Europe, South East Asia, and South America. Engineered sleeve packs have superior shipping efficiency, hygienics, ergonomics, and reverse logistics, making them the best bulk solution for many applications. Specifically, sleeve packs provide: Shipping Efficiency maximum amount of product per trailer load; Reverse Logistics require less return freight; Hygienics can be cleaned and sanitized (required for pharma, medical, caps and closures, and food); and Safety and Ergonomics often safer, easier to use.

Additional background art includes U.S. Pat. No. 9,764,876 disclosing a sleeve pack having a pallet and top cap with one or more dividers disposed therebetween and one or more sleeves disposed between the pallet and each divider or top cap.

German Patent No. DE102005031526B4 disclosing a transport container with a pallet base, which has a support edge, wherein the support edge and the pallet base are made in a Twinsheet process of a thermoformable plastic material and bivalves of an inner skin and an outer skin, characterized in that in the pallet base a reinforcing frame is integrated, which extends into corner regions of the pallet base, and that foot parts are detachably secured to the corner regions of the pallet base, which are dimensioned such that they correspond to corresponding corner regions at least with a partial region of their base surface of the reinforcing frame overlap.

European Patent No. EP2256051B1 discloses a container that has a base, and side walls that are foldable and connected with one another. One of the side walls is connected with the base at a bottom edge using a hinge. The hinge is movably supported at the base and arranged perpendicular to a plane of the base. The side walls are connected at perpendicular container edges and are fitted on the base in a foldable manner. The base consists of a plastic molded part and slots, where the slots are formed as feet and molded downward. Latching noses are arranged at a groove for contacting a recess of the sidewalls.

European Patent No. EP2783996B1 discloses a sleeve pack assembly with a latching mechanism that can be engaged by an operator's foot when in an upright position. The latching mechanism includes a front facing engagement panel. The engagement panel is connected to a spring element and to one or more projections or prongs for engaging and/or disengaging apertures in at least one side of a sleeve.

British Patent Application No. GB2440327A discloses a packaging module that comprises a pallet, which includes a generally planar support surface, and a sleeve. The sleeve is configurable in an erect configuration in which it bounds a hollow storage area on the support surface of the pallet, and a collapsed configuration in which it is folded to lie on the support surface of the pallet. The sleeve is coupled with the pallet so as to facilitate movement of the sleeve between its erect and collapsed configurations. The coupling preferably includes at least one protrusion and at least one co-operating recess, where the at least one protrusion preferably defines a hinge.

Japanese Patent No. JP4983419B2 discloses a transport container capable of performing a fixing operation in an easy posture when fixing a pallet and a sleeve. An engagement hole is provided in a sleeve, and a pallet is provided with a lock member that engages with the engagement hole. The lock member has a main body, an operation claw portion provided so as to protrude from the main body to the outside of the pallets. An engaging claw portion that can be fitted into the joint hole is provided. When the operator presses the operation claw portion, the engagement claw portion and the engagement hole can be fitted or released.

Japanese Patent Application No. JP2009107703A discloses a transportation container enhanced in storage efficiency at non-use by reducing the folding size of a sleeve. The transportation container comprises a bottom plate having holding grooves of continuous recessed cross-sectional shapes at the outer peripheral end of its upper surface, sleeves of which lower ends are fitted into the holding grooves, formed into box shapes of which the both upper and lower surfaces are opened and a valley folding part and a mountain folding part facing up or down formed at each of the center part in the lateral direction of two side plates opposing each other, and an upper lid mounted at the upper end of the sleeves in which the holding grooves of upward recessed cross sections having upper ends of the sleeves are fitted at outer peripheral ends of the lower surface.

U.S. Pat. No. 3,374,915A disclosing a knock-down or collapsible type container that has the side and end walls seated in a groove around the edge of a base. The end walls engage the side walls on assembly and are connected to the base to form an opened top container. A top is placed on the side and end walls in mating engagement with the top edge of the side and end walls to close the container. The base is formed to provide a storage space for the side and end walls and the top is used to hold the walls in place on the base.

U.S. Pat. No. 5,109,985A disclosing a palletized container that includes a member defining sidewalls for the container, at least one reusable end cap for attachment to the sidewalls as the end cap receives an end of the sidewall-defining member, and a locking system for locking the sidewall-defining member to the end cap. The sidewall-defining member includes a notch adjacent one of its ends, and the locking system includes a slide bar slidably retained within the notch for movement between an advanced position and a retracted position. The end cap includes an outermost wall positionable outside of a sidewall when the sidewall-defining member is received by the end cap, and the outermost wall includes a slotted boss protruding generally inwardly of the outermost wall. When the sidewall-defining member is received by the end cap, the slots in the boss accept the slide bar when it is moved from its retracted position toward its advanced position to thereby lock the sidewall-defining member to the end cap.

U.S. Pat. No. 5,538,178A disclosing a sleeve pack assembly to be used to form a container that comprises four vertical wall panels having hinged side flaps wherein the flaps and panels form doubled panel edge structures with securing edges along the flap edges. Four cornerposts hold the panels together and each comprises two generally perpendicular longitudinal channels which define a slot to receive the doubled edge structure and side flap of a panel. At least one channel wall includes a hooking edge, protruding inwardly of the slot, which abuts against the securing edge of the flap to lock the side flap and doubled edge structure into the cornerpost slots to hold the wall panels together into a sleeve pack assembly. In a collapsible embodiment of the sleeve pack, the longitudinal channels are in separate pieces which are hinged together to form a hingable cornerpost. The collapsible sleeve pack assembly further includes two opposing wall panels which are scored to be folded, and the sleeve pack assembly is collapsible. A rigid sleeve pack assembly embodiment utilizes a one piece cornerpost having two longitudinal channel sections to receive the doubled panel edge structures and side flaps.

U.S. Pat. No. 5,538,178A disclosing a latch mechanism that is mounted on a pallet adjacent the peripheral rim thereof. The latch mechanism is selectively transitionable between an engaged position, wherein the latch mechanism engages the lock slot thereby securing the side wall to the pallet and a disengaged position wherein the latch mechanism is not engaged with the lock slot thereby allowing the side wall to be removed from the pallet. A fixed bracket is mounted on the pallet adjacent the peripheral rim and spaced apart from the latch mechanism. The fixed bracket is arranged and configured to receive and engage the coupling structure from a first direction. When the fixed bracket and the coupling structure are engaged, the fixed bracket restricts movement of the side wall with respect to the pallet in a second direction.

U.S. Pat. No. 5,908,135A disclosing a sleeve pack to be used with a pallet base and cover to form a container for shipping bulk goods comprises four vertical walls arranged such that each vertical wall is orthogonal to two adjacent walls. At least one vertical wall of corrugated plastic is joined by an edge-to-edge butt welded seam. In a preferred embodiment of the present invention a vertical wall panel having vertically oriented corrugations is edge-to-edge butt welded with a corner piece of corrugated plastic having horizontally oriented corrugations to form a continuous one ply sleeve pack. An alternative embodiment of the present invention is a double thickness, corrugated plastic sleeve pack in which one thickness has horizontal corrugations for side impact resistance and the other thickness has vertically oriented corrugations for increased stacking strength but with all seams butt welded.

U.S. Pat. No. 6,024,223 disclosing a storage container including a pallet having a section which defines a mounting clip receiving slot and a sidewall structure having a mounting clip secured near an edge thereof. The mounting clip has a first section including a movable latch/release handle and a second section including a locking toggle operatively associated with the movable latch/release handle. The second section is inserted into the slot and the locking toggle is moved by the movable latch/release handle from an unlatched position to a latched position. In this way, the sidewall structure is attached to the pallet. The invention also includes the mounting clip itself (as described above) as well as a method of forming a storage container wherein a pallet, a bin and a mounting clip.

U.S. Pat. No. 6,902,061 disclosing a collapsible box for storing liquids, the box capable of being stacked while filled and then collapsed for convenient storage and return shipping when not filled. The box includes a base having a lip extending upwardly along the edges of the bottom panel. An upper sleeve is connected to the base by a base hinge, the upper panel being foldable by way of several other hinges to either an open or a closed position. A lid has a lip extending downwardly to selectively surround the top edges of the upper sleeve when the upper sleeve is in the open position, thereby forming an enclosure.

U.S. Pat. Nos. 8,112,859, 8,146,224 and 8,523,004 disclosing custom sized plastic tote having intermediate sleeve and methods of manufacturing a custom sized plastic tote lighter in weight than heretofore known custom sized plastic totes is provided. The method comprises separating an injection molded tote into upper and lower portions by cutting the injection molded tote. A sleeve or middle portion of plastic material is secured to the upper and lower portions of the injection molded tote to create a custom sized plastic tote of a desired height. Alternatively, portions of different injection molded totes may be used to create a custom sized plastic tote. The sleeve may be made from different materials and may be made of multiple pieces.

U.S. Pat. No. 9,487,329 disclosing a sleeve pack assembly with a latching mechanism that can be engaged by an operator's foot when in an upright position. The latching mechanism includes a front facing engagement panel. The engagement panel is connected to a spring element in the pallet and to one or more projections or prongs for engaging and/or disengaging apertures in at least one side of a sleeve.

SUMMARY OF THE INVENTION

Following is a non-exclusive list including some examples of embodiments of the invention. The invention also includes embodiments which include fewer than all the features in an example and embodiments using features from multiple examples, also if not expressly listed below.

Example 1. A collapsible container, comprising:

a. a base comprising a back side, a front side, a left side, a right side and a top surface, said top surface comprising at least one back groove located at the perimeter of said back side, at least one front groove located at the perimeter of said front side, at least one left groove located at the perimeter of said left side and at least one right groove located at the perimeter of said right side;

b. a first sleeve having a first set of three flat surfaces, one back central flat surface as long as said back side of said base, one back left side flat surface partially extending along said left side of said base and one back right side flat surface partially extending along said right side of said base;

said back central flat surface comprising an extension of said flat surface at a bottom of said back central flat surface; said extension adapted to be inserted in said at least one back groove located at said back side of said surface;

said back left flat surface comprising an extension of said flat surface at a bottom of said back left flat surface; said extension adapted to be inserted in said at least one left groove located at said left side of said surface, said extension being shorter in length than a total length of said bottom of said back left flat surface;

said back right flat surface comprising an extension of said flat surface at a bottom of said back right flat surface; said extension adapted to be inserted in said at least one right groove located at said right side of said surface, said extension being shorter in length than a total length of said bottom of said back right flat surface;

c. a second sleeve having a second set of three flat surfaces, one front central flat surface as long as said front side of said base, one front left side flat surface partially extending along said left side of said base and one front right side flat surface partially extending along said right side of said base;

said front central flat surface comprising an extension of said flat surface at a bottom of said front central flat surface; said extension adapted to be inserted in said at least one front groove located at said front side of said surface;

wherein when said first sleeve and said second sleeve are located in their respective grooves, they completely surround said base.

Example 2. The collapsible container according to example 1, further comprising a cover.

Example 3. The collapsible container according to example 1 or example 2, further comprising a reversible holder for holding said first sleeve and said second sleeve together.

Example 4. The collapsible container according to any one of examples 1-3, wherein components of said collapsible container are made of recycled materials.

Example 5. The collapsible container according to any one of examples 1-4, wherein said first sleeve and said second sleeve collapse to a folded configuration, and in said folded configuration the size of said sleeves is smaller than the size of the surface of said base.

Example 6. The collapsible container according to any one of examples 1-5, wherein said base further comprises metal inserts within said base.

Example 7. The collapsible container according to any one of examples 1-6, wherein said base comprises one or more elements at the bottom surface of said base for connecting one or more extension legs.

Example 8. The collapsible container according to example 7, wherein said cover comprises one or more indentations for receiving said one or more extension legs when more than one collapsible container is positioned on top one another.

Example 9. The collapsible container according to any one of examples 1-8, wherein said at least one left groove and said at least one right groove do not reach said at least one back groove.

Example 10. The collapsible container according to any one of examples 1-9, wherein said base comprises a flap on a periphery of said back side, said front side, said left side and said right side of said top surface, said flap extending upwards from said top surface.

Example 11. The collapsible container according to example 10, wherein said flap holds said first sleeve and said second sleeve in place.

Example 12. The collapsible container according to any one of examples 1-11, wherein said base does not comprise angled grooves in corners of said base.

Example 13. The collapsible container according to any one of examples 1-12, wherein said at least one back groove, said at least one front groove, said at least one left groove and said at least one right groove comprise an inward tapering on at least a part of the external side said groves.

Example 14. The collapsible container according to any one of examples 1-13, wherein said first set of three flat surfaces of said first sleeve generate a first C-shape sleeve; and wherein said second set of three flat surfaces of said second sleeve generate a second C-shape sleeve.

Example 15. The collapsible container according to example 14, wherein said first C-shape sleeve is bigger than said second C-shape sleeve.

Example 16. The collapsible container according to any one of examples 1-15, wherein at least one of the following is true:

a. said back left surface is wider than said front left surface; and b. said back right surface is wider than said front right surface.

Example 17. The collapsible container according to any one of examples 1-16, wherein said front right side surface and said back right side surface are configured to cover the entire perimeter of the right side of the base; and wherein said front left side surface and said back left side surface are configured to cover the entire perimeter of the left side of the base.

Example 18. The collapsible container according to any one of examples 1-17, wherein at least one of the following is true:

a. said front right side surface and said back right side surface comprise an overlapping area between them;

b. said front left side surface and said back left side surface comprise an overlapping area between them.

Example 19. The collapsible container according to example 3, wherein said reversible holder comprise at least two parts, one part of said two parts located in said first sleeve and another part of said of said two parts located in said second sleeve.

Example 20. The collapsible container according to example 3, wherein said collapsible container comprises at least two reversible holders.

Example 21. The collapsible container according to any one of examples 1-20, further comprising one or more additional holder elements in said base and one or more dedicated orifices in said first sleeve and/or said second sleeve for allowing insertion of said one or more additional holder elements therein.

Example 22. The collapsible container according to example 21, wherein at least one of the following is true:

a. said one or more additional holder engages said one or more dedicated orifices passively; and b. said one or more additional holder actively engages said one or more dedicated orifices by a user.

Example 23. The collapsible container according to any one of examples 1-22, further comprising one or more reinforcement inserts in said base; and wherein said reinforcement inserts are made of steel.

Example 24. A collapsible container, comprising:

a. a base comprising a top surface comprising a plurality of corners, said base further comprising discontinuous extension-receiving receptacles located at a perimeter of said top surface of said base;

b. a first sleeve having a first set of three flat surfaces; wherein at least one first flat surface of said first set of three flat surfaces comprises an extension of said first flat surface adapted to be inserted in said discontinuous extension-receiving receptacle;

c. a second sleeve having a second set of three flat surfaces; wherein at least one second flat surface of said second set of three flat surfaces comprises an extension of said second flat surface adapted to be inserted in said discontinuous extension-receiving receptacle;

wherein when said extensions are located in their respective discontinuous extension-receiving receptacles, said first and second sleeves surround said base.

Example 25. The collapsible container according to example 24, wherein said discontinuous extension-receiving elements comprise grooves.

Example 26. The collapsible container according to example 24 or example 25, wherein said discontinuous extension-receiving elements do not meet at at least one of said plurality of corners of said base.

Example 27. The collapsible container according to any one of examples 24-26, wherein said base comprises a back side, a front side, a left side and a right side.

Example 28. The collapsible container according to any one of examples 24-27, wherein said top surface comprises at least one back discontinuous extension-receiving receptacle located at said perimeter of said back side, at least one front discontinuous extension-receiving receptacle located at said perimeter of said front side, at least one left discontinuous extension-receiving receptacle located at said perimeter of said left side and at least one right discontinuous extension-receiving receptacle located at said perimeter of said right side.

Example 29. The collapsible container according to any one of examples 24-28, wherein said first set of three flat surfaces of said first sleeve comprises at least one back central flat surface, at least one back left side flat surface and at least one back right side flat surface.

Example 30. The collapsible container according to example 29, wherein at least one of the following is true:

a. said at least one back central flat surface is as long as said back side of said base, said at least one back left side flat surface partially extends along said left side of said base and said at least one back right side flat surface partially extends along said right side of said base;

b. said back central flat surface comprises an extension of said flat surface at a bottom of said back central flat surface; said extension adapted to be inserted in said at least one back discontinuous extension-receiving receptacle located at said back side of said surface;

c. said back left flat surface comprises an extension of said flat surface at a bottom of said back left flat surface; said extension adapted to be inserted in said at least one left discontinuous extension-receiving receptacle located at said left side of said surface, said extension being shorter in length than a total length of said bottom of said back left flat surface; and d. said back right flat surface comprising an extension of said flat surface at a bottom of said back right flat surface; said extension adapted to be inserted in said at least one right discontinuous extension-receiving receptacle located at said right side of said surface, said extension being shorter in length than a total length of said bottom of said back right flat surface.

Example 31. The collapsible container according to any one of examples 24-30, wherein said second set of three flat surfaces of said second sleeve comprises at least one front central flat surface, at least one front left side flat surface and at least one front right side flat surface; and wherein at least one of the following is true:

a. said at least one front central flat surface is as long as said front side of said base, said at least one front left side flat surface partially extends along said left side of said base and one front right side flat surface partially extends along said right side of said base; and b. said front central flat surface comprises said extension of said flat surface at a bottom of said front central flat surface; said extension adapted to be inserted in said at least one front discontinuous extension-receiving receptacle located at said front side of said surface.

Example 32. The collapsible container according to any one of examples 24-31, further comprising a cover.

Example 33. The collapsible container according to any one of examples 24-32, further comprising a reversible holder for holding said first sleeve and said second sleeve together.

Example 34. The collapsible container according to any one of examples 24-33, wherein components of said collapsible container are made of recycled materials.

Example 35. The collapsible container according to any one of examples 24-34, wherein said first sleeve and said second sleeve collapse to a folded configuration, and in said folded configuration the size of said sleeves is smaller than the size of the surface of said base.

Example 36. The collapsible container according to any one of examples 24-35, wherein said base comprises one or more elements at the bottom surface of said base for connecting one or more extension legs; and wherein said cover comprises indentation for receiving said one or more extension legs when more than one collapsible container is positioned on top one another.

Example 37. The collapsible container according to any one of examples 24-36, wherein said at least one left discontinuous extension-receiving receptacle and said at least one right discontinuous extension-receiving receptacle do not reach said at least one back discontinuous extension-receiving receptacle.

Example 38. The collapsible container according to any one of examples 24-37, wherein said base comprises a flap on a periphery of said back side, said front side, said left side and said right side of said top surface, said flap extending upwards from said top surface; and wherein said flap holds said first sleeve and said second sleeve in place.

Example 39. The collapsible container according to any one of examples 24-38, wherein said base does not comprise angled discontinuous extension-receiving receptacle in corners of said base; and wherein said at least one back discontinuous extension-receiving receptacle, said at least one front discontinuous extension-receiving receptacle, said at least one left discontinuous extension-receiving receptacle and said at least one right discontinuous extension-receiving receptacle comprise an inward tapering on at least a part of the external side said discontinuous extension-receiving receptacles.

Example 40. The collapsible container according to any one of examples 24-39, wherein said first set of three flat surfaces of said first sleeve generate a first C-shape sleeve; and wherein said second set of three flat surfaces of said second sleeve generate a second C-shape sleeve.

Example 41. The collapsible container according to example 40, wherein said first C-shape sleeve is bigger than said second C-shape sleeve.

Example 42. The collapsible container according to any one of examples 24-41, wherein at least one of the following is true:

a. said back left surface is wider than said front left surface; and b. said back right surface is wider than said front right surface.

Example 43. The collapsible container according to any one of examples 24-42, wherein said front right side surface and said back right side surface are configured to cover the entire perimeter of the right side of the base; and wherein said front left side surface and said back left side surface are configured to cover the entire perimeter of the left side of the base.

Example 44. The collapsible container according to any one of examples 24-43, wherein at least one of the following is true:

a. said front right side surface and said back right side surface comprise an overlapping area between them; and b. said front left side surface and said back left side surface comprise an overlapping area between them.

Example 45. The collapsible container according to any one of examples 24-44, wherein at least one of the following is true:

a. said reversible holder comprise at least two parts, one part of said two parts located in said first sleeve and another part of said of said two parts located in said second sleeve; and b. said collapsible container comprises at least two reversible holders.

Example 46. The collapsible container according to any one of examples 24-45, further comprising one or more additional holder elements in said base and one or more dedicated orifices in said first sleeve and/or said second sleeve for allowing insertion of said one or more additional holder elements therein.

Example 47. The collapsible container according to example 46, wherein at least one of the following is true:

a. said one or more additional holder engages said one or more dedicated orifices passively; and b. said one or more additional holder actively engages said one or more dedicated orifices by a user.

Example 48. The collapsible container according to any one of examples 24-47, further comprising one or more reinforcement inserts in said base; and wherein said reinforcement inserts are made of steel.

Example 49. A method of operating a collapsible container, said collapsible container according to example 1 or example 30, said method comprising:

a. placing a base on a surface;

b. placing an extension of a back surface of a back sleeve in a discontinuous extension-receiving receptacle of said base, optionally while holding said back sleeve with an angle;

c. inserting extensions of a back right side surface and a back left side surface into discontinuous extension-receiving receptacles of said base;

d. placing an extension of a front surface of a front sleeve in a discontinuous extension-receiving receptacle on said base;

e. straightening said front sleeve so a front right side surface and a front left side surface rest on a surface of said base, while interconnecting a reversible holding mechanism;

f. interlocking between parts of said reversible holding mechanism by pushing down said front sleeve;

g. mounting a cover.

Example 50. A base for a collapsible container comprising a top surface comprising discontinuous extension-receiving receptacles located at a periphery of said top surface of said base.

Following is an additional non-exclusive list including some examples of embodiments of the invention. The invention also includes embodiments which include fewer than all the features in an example and embodiments using features from multiple examples, also if not expressly listed below.

Example 1'. A collapsible container, comprising:

a. a base comprising a back side, a front side, a left side, a right side and a top surface;

said top surface comprising at least one back groove located at the perimeter of said back side, at least one front groove located at the perimeter of said front side, at least one left groove located at the perimeter of said left side and at least one right groove located at the perimeter of said right side;

b. a first sleeve having a first set of three flat surfaces, one back central flat surface as long as said back side of said base, one back left side flat surface partially extending along said left side of said base and one back right side flat surface partially extending along said right side of said base;

said back central flat surface comprising an extension of said flat surface at a bottom of said back central flat surface; said extension adapted to be inserted in said at least one back groove located at said back side of said surface;

said back left flat surface comprising an extension of said flat surface at a bottom of said back left flat surface; said extension adapted to be inserted in said at least one left groove located at said left side of said surface, said extension being shorter in length than a total length of said bottom of said back left flat surface;

said back right flat surface comprising an extension of said flat surface at a bottom of said back right flat surface; said extension adapted to be inserted in said at least one right groove located at said right side of said surface, said extension being shorter in length than a total length of said bottom of said back right flat surface;

c. a second sleeve having a second set of three flat surfaces, one front central flat surface as long as said front side of said base, one front left side flat surface partially extending along said left side of said base and one front right side flat surface partially extending along said right side of said base;

said front central flat surface comprising an extension of said flat surface at a bottom of said front central flat surface; said extension adapted to be inserted in said at least one front groove located at said front side of said surface;

wherein when said first sleeve and said second sleeve are located in their respective grooves, they completely surround said base.

Example 2'. The collapsible container according to example 1', further comprising a cover.

Example 3'. The collapsible container according to example 1' or example 2', further comprising a reversible holder for holding said first sleeve and said second sleeve together.

Example 4'. The collapsible container according to any one of examples 1'-3', wherein components of said collapsible container are made of recycled materials.

Example 5'. The collapsible container according to any one of examples 1'-4', wherein said first sleeve and said second sleeve collapse to a folded configuration, and in said folded configuration the size of said sleeves is smaller than the size of the surface of said base.

Example 6'. The collapsible container according to any one of examples 1'-5', wherein said base further comprises metal inserts within said base.

Example 7'. The collapsible container according to any one of examples 1'-6', wherein said base comprises one or more elements at the bottom surface of said base for connecting one or more extension legs.

Example 8'. The collapsible container according to example 7', wherein said cover comprises indentation for receiving said one or more extension legs when more than one collapsible container is positioned on top one another.

Example 9'. The collapsible container according to any one of examples 1'-8', wherein said at least one left groove and said at least one right groove do not reach said at least one back groove.

Example 10'. The collapsible container according to any one of examples 1'-9', wherein said base comprises a flap on a periphery of said back side, said front side, said left side and said right side of said top surface, said flap extending upwards from said top surface.

Example 11'. The collapsible container according to example 10', wherein said flap holds said first sleeve and said second sleeve in place.

Example 12'. The collapsible container according to any one of examples 1'-11, wherein said base does not comprise angled grooves in corners of said base.

Example 13'. The collapsible container according to any one of examples 1'-12', wherein said at least one back groove, said at least one front groove, said at least one left groove and said at least one right groove comprise an inward tapering on at least a part of the external side said groves.

Example 14'. The collapsible container according to any one of examples 1'-13', wherein said first set of three flat surfaces of said first sleeve generate a first C-shape sleeve.

Example 15'. The collapsible container according to any one of examples 1'-13', wherein said second set of three flat surfaces of said second sleeve generate a second C-shape sleeve.

Example 16'. The collapsible container according to example 15', wherein said first C-shape sleeve is bigger than said second C-shape sleeve.

Example 17'. The collapsible container according to any one of examples 1'-16', wherein said back left surface is wider than said front left surface.

Example 18'. The collapsible container according to any one of examples 1'-16', wherein said back right surface is wider than said front right surface.

Example 19'. The collapsible container according to any one of examples 1'-18', wherein said front right side surface and said back right side surface are configured to cover the entire perimeter of the right side of the base.

Example 20'. The collapsible container according to any one of examples 1'-18', wherein said front left side surface and said back left side surface are configured to cover the entire perimeter of the left side of the base.

Example 21'. The collapsible container according to any one of examples 1'-20', wherein said front right side surface and said back right side surface comprise an overlapping area between them.

Example 22'. The collapsible container according to any one of examples 1'-20', wherein said front left side surface and said back left side surface comprise an overlapping area between them.

Example 23'. The collapsible container according to example 3', wherein said reversible holder comprise at least two parts, one part of said two parts located in said first sleeve and another part of said of said two parts located in said second sleeve.

Example 24'. The collapsible container according to example 3', wherein said collapsible container comprises at least two reversible holders.

Example 25'. The collapsible container according to any one of examples 1'-24', further comprising one or more additional holder elements in said base and one or more dedicated orifices in said first sleeve and/or said second sleeve for allowing insertion of said one or more additional holder elements therein.

Example 26'. The collapsible container according to example 25', wherein said one or more additional holder engages said one or more dedicated orifices passively.

Example 27'. The collapsible container according to example 25', wherein said one or more additional holder actively engages said one or more dedicated orifices by a user.

Example 28'. The collapsible container according to any one of examples 1'-27', further comprising one or more reinforcement inserts in said base.

Example 29'. The collapsible container according to example 28', wherein said reinforcement inserts are made of steel.

Example 30'. A collapsible container, comprising:

a. a base comprising a top surface comprising a plurality of corners, said base further comprising discontinuous extension-receiving receptacles located at a perimetry of said top surface of said base;

b. a first sleeve having a first set of three flat surfaces; wherein at least one first flat surface of said first set of three flat surfaces comprises an extension of said first flat surface adapted to be inserted in said discontinuous extension-receiving receptacle;

c. a second sleeve having a second set of three flat surfaces; wherein at least one second flat surface of said second set of three flat surfaces comprises an extension of said second flat surface adapted to be inserted in said discontinuous extension-receiving receptacle;

wherein when said extensions are located in their respective discontinuous extension-receiving receptacles, said first and second sleeves surround said base.

Example 31'. The collapsible container according to example 30', wherein said discontinuous extension-receiving elements comprise grooves.

Example 32'. The collapsible container according to example 30' or example 31, wherein said discontinuous extension-receiving elements do not meet at at least one of said plurality of corners of said base.

Example 33'. The collapsible container according to any one of examples 30'-32', wherein said base comprises a back side, a front side, a left side and a right side.

Example 34'. The collapsible container according to any one of examples 30'-33', wherein said top surface comprises at least one back discontinuous extension-receiving receptacle located at said perimeter of said back side, at least one front discontinuous extension-receiving receptacle located at said perimeter of said front side, at least one left discontinuous extension-receiving receptacle located at said perimeter of said left side and at least one right discontinuous extension-receiving receptacle located at said perimeter of said right side.

Example 35'. The collapsible container according to any one of examples 30'-34', wherein said first set of three flat surfaces of said first sleeve comprises at least one back central flat surface, at least one back left side flat surface and at least one back right side flat surface.

Example 36'. The collapsible container according to example 35', wherein said at least one back central flat surface is as long as said back side of said base, said at least one back left side flat surface partially extends along said left side of said base and said at least one back right side flat surface partially extends along said right side of said base.

Example 37'. The collapsible container according to example 35', wherein said back central flat surface comprises an extension of said flat surface at a bottom of said back central flat surface; said extension adapted to be inserted in said at least one back discontinuous extension-receiving receptacle located at said back side of said surface.

Example 38'. The collapsible container according to example 35', wherein said back left flat surface comprises an extension of said flat surface at a bottom of said back left flat surface; said extension adapted to be inserted in said at least one left discontinuous extension-receiving receptacle located at said left side of said surface, said extension being shorter in length than a total length of said bottom of said back left flat surface.

Example 39'. The collapsible container according to example 35', wherein said back right flat surface comprising an extension of said flat surface at a bottom of said back right flat surface; said extension adapted to be inserted in said at least one right discontinuous extension-receiving receptacle located at said right side of said surface, said extension being shorter in length than a total length of said bottom of said back right flat surface.

Example 40'. The collapsible container according to any one of examples 30'-39', wherein said second set of three flat surfaces of said second sleeve comprises at least one front central flat surface, at least one front left side flat surface and at least one front right side flat surface.

Example 41'. The collapsible container according to example 40', wherein said at least one front central flat surface is as long as said front side of said base, said at least one front left side flat surface partially extends along said left side of said base and one front right side flat surface partially extends along said right side of said base.

Example 42'. The collapsible container according to example 40', wherein said front central flat surface comprises said extension of said flat surface at a bottom of said front central flat surface; said extension adapted to be inserted in said at least one front discontinuous extension-receiving receptacle located at said front side of said surface.

Example 43'. The collapsible container according to any one of examples 30'-42', further comprising a cover.

Example 44'. The collapsible container according to any one of examples 30'-43', further comprising a reversible holder for holding said first sleeve and said second sleeve together.

Example 45'. The collapsible container according to any one of examples 30'-44', wherein components of said collapsible container are made of recycled materials.

Example 46'. The collapsible container according to any one of examples 30'-45', wherein said first sleeve and said second sleeve collapse to a folded configuration, and in said folded configuration the size of said sleeves is smaller than the size of the surface of said base.

Example 47'. The collapsible container according to any one of examples 30'-46', wherein said base further comprises metal inserts within said base.

Example 48'. The collapsible container according to any one of examples 30'-47', wherein said base comprises one or more elements at the bottom surface of said base for connecting one or more extension legs.

Example 49'. The collapsible container according to example 48', wherein said cover comprises indentation for receiving said one or more extension legs when more than one collapsible container is positioned on top one another.

Example 50'. The collapsible container according to any one of examples 30'-49', wherein said at least one left discontinuous extension-receiving receptacle and said at least one right discontinuous extension-receiving receptacle do not reach said at least one back discontinuous extension-receiving receptacle.

Example 51'. The collapsible container according to any one of examples 30'-50', wherein said base comprises a flap on a periphery of said back side, said front side, said left side and said right side of said top surface, said flap extending upwards from said top surface.

Example 52'. The collapsible container according to example 51', wherein said flap holds said first sleeve and said second sleeve in place.

Example 53'. The collapsible container according to any one of examples 30'-52', wherein said base does not comprise angled discontinuous extension-receiving receptacle in corners of said base.

Example 54'. The collapsible container according to example 53', wherein said at least one back discontinuous extension-receiving receptacle, said at least one front discontinuous extension-receiving receptacle, said at least one left discontinuous extension-receiving receptacle and said at least one right discontinuous extension-receiving receptacle comprise an inward tapering on at least a part of the external side said discontinuous extension-receiving receptacles.

Example 55'. The collapsible container according to any one of examples 30'-54', wherein said first set of three flat surfaces of said first sleeve generate a first C-shape sleeve.

Example 56'. The collapsible container according to any one of examples 30'-55', wherein said second set of three flat surfaces of said second sleeve generate a second C-shape sleeve.

Example 57'. The collapsible container according to example 56', wherein said first C-shape sleeve is bigger than said second C-shape sleeve.

Example 58'. The collapsible container according to examples 35' and 40', wherein said back left surface is wider than said front left surface.

Example 59'. The collapsible container according to examples 35' and 40', wherein said back right surface is wider than said front right surface.

Example 60'. The collapsible container according to examples 35' and 40', wherein said front right side surface and said back right side surface are configured to cover the entire perimeter of the right side of the base.

Example 61'. The collapsible container according to examples 35' and 40', wherein said front left side surface and said back left side surface are configured to cover the entire perimeter of the left side of the base.

Example 62'. The collapsible container according to examples 35' and 40', wherein said front right side surface and said back right side surface comprise an overlapping area between them.

Example 63'. The collapsible container according to examples 35' and 40', wherein said front left side surface and said back left side surface comprise an overlapping area between them.

Example 64'. The collapsible container according to example 44', wherein said reversible holder comprise at least two parts, one part of said two parts located in said first sleeve and another part of said of said two parts located in said second sleeve.

Example 65'. The collapsible container according to example 44', wherein said collapsible container comprises at least two reversible holders.

Example 66'. The collapsible container according to any one of examples 30'-65', further comprising one or more additional holder elements in said base and one or more dedicated orifices in said first sleeve and/or said second sleeve for allowing insertion of said one or more additional holder elements therein.

Example 67'. The collapsible container according to example 66', wherein said one or more additional holder engages said one or more dedicated orifices passively.

Example 68'. The collapsible container according to example 66', wherein said one or more additional holder actively engages said one or more dedicated orifices by a user.

Example 69'. The collapsible container according to any one of examples 30'-68', further comprising one or more reinforcement inserts in said base.

Example 70'. The collapsible container according to example 69', wherein said reinforcement inserts are made of steel.

Example 71'. A method of operating a collapsible container, said collapsible container according to example 1' or example 30', said method comprising:

a. placing a base on a surface;
b. placing an extension of a back surface of a back sleeve in a discontinuous extension-receiving receptacle of said base, optionally while holding said back sleeve with an angle;
c. inserting extensions of a back right side surface and a back left side surface into discontinuous extension-receiving receptacles of said base;
d. placing an extension of a front surface of a front sleeve in a discontinuous extension-receiving receptacle on said base;
e. straightening said front sleeve so a front right side surface and a front left side surface rest on a surface of said base, while interconnecting a reversible holding mechanism;
f. interlocking between parts of said reversible holding mechanism by pushing down said front sleeve;
g. mounting a cover.

Example 72'. A base for a collapsible container comprising a top surface comprising discontinuous extension-receiving receptacles located at a periphery of said top surface of said base.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings:

FIGS. 8*a-b* are schematic representations of sizes of exemplary bases, according to some embodiments of the invention;

DESCRIPTION OF SPECIFIC EMBODIMENTS OF THE INVENTION

Figure 1A:
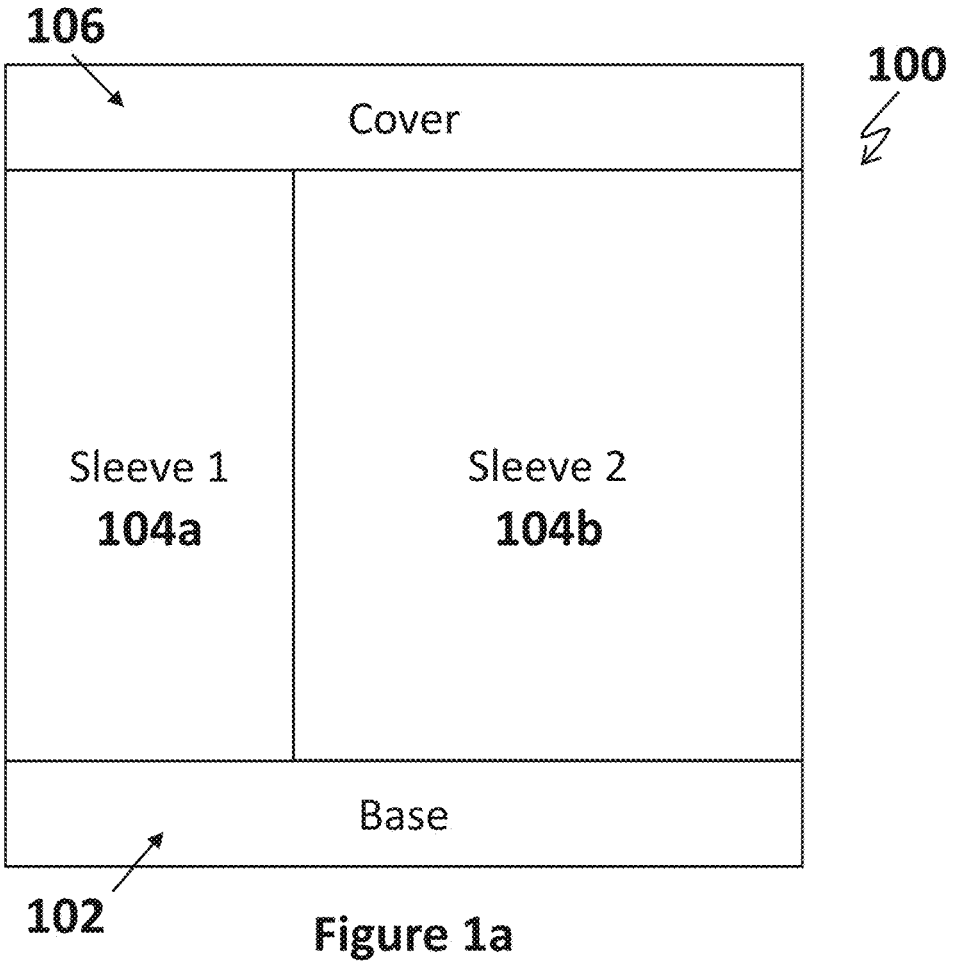
FIGS. 1*a* and 1*b* are schematic overviews of exemplary components of an exemplary transport system, according to some embodiments of the invention.

The present invention, in some embodiments thereof, relates to relates to a base for transporting goods comprising a sleeve and, more particularly, but not exclusively, to a base for transporting goods comprising a foldable sleeve.

Overview

An aspect of some embodiments of the invention relates to transport systems comprising a base, one or more sleeves and optionally a cover, where the connection between the sleeves and the base comprise extensions on the sleeves that enter grooves in the base, where grooves on the base do not extend along the whole periphery of the base and extensions of the sleeve do not extend along the whole bottom side of the sleeve. In some embodiments, mechanical stability between the base and the sleeves do not require from either the groove and/or the sleeve to extend along the whole periphery of the base/sleeve. In some embodiments, the grooves comprise an inward tapering on at least a part of the external side of the grove. In some embodiments, the grooves on the base are located in places for the reduction of pressure on the sleeve when installed and/or removed from the base. In some embodiments, the base does not comprise grooves that are 'full angle groove' on the corners of the base. In some embodiments, places without groove on the surface of the base provide an easy to clean surface of the base and/or potentially avoid accumulation of obstructive material inside the groove by the elimination of the groove. In some embodiments, the sleeves can be folded and placed on the top surface of the base and covered by the cover. In some embodiments, a plurality of transport systems are stackable one on top of another in either an open configuration or in a closed configuration.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Figure 1B:
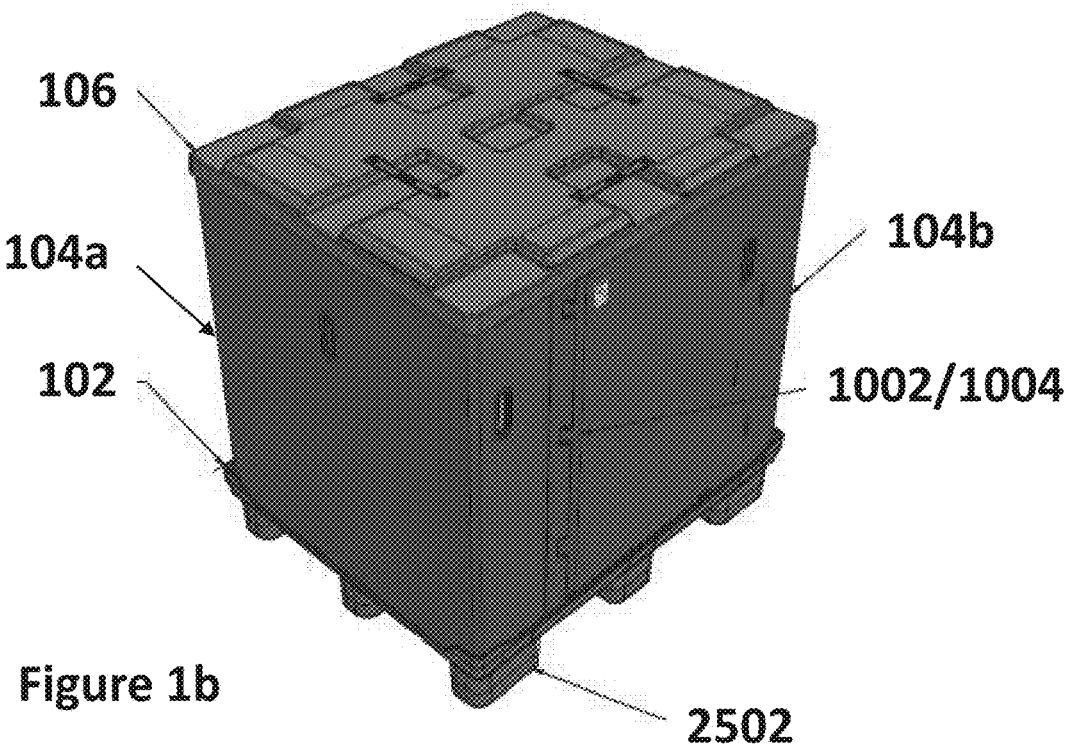

Referring now to FIGS. 1*a* and 1*b* illustrating a schematic overview of exemplary components of an exemplary transport system according to some embodiments of the invention. In some embodiments, the transport system 100 comprises a base 102, one or more sleeves 104*a-b* (in FIGS. 1*a-b* are shown 2 sleeves) and a cover 106. In some embodiments, the components of the transport system 100 comprise features for reversibly interconnecting the components, as will be further explained below.

In some embodiments, the transport system 100 comprises a plurality of states: a folded state, a partially deployed state and a fully deployed state.

In some embodiments, a fully deployed state is as schematically shown for example in FIGS. 1*a-b*, where the base 102, the sleeves 104*a-b* and cover 106 are all interconnected.

Figure 2A:
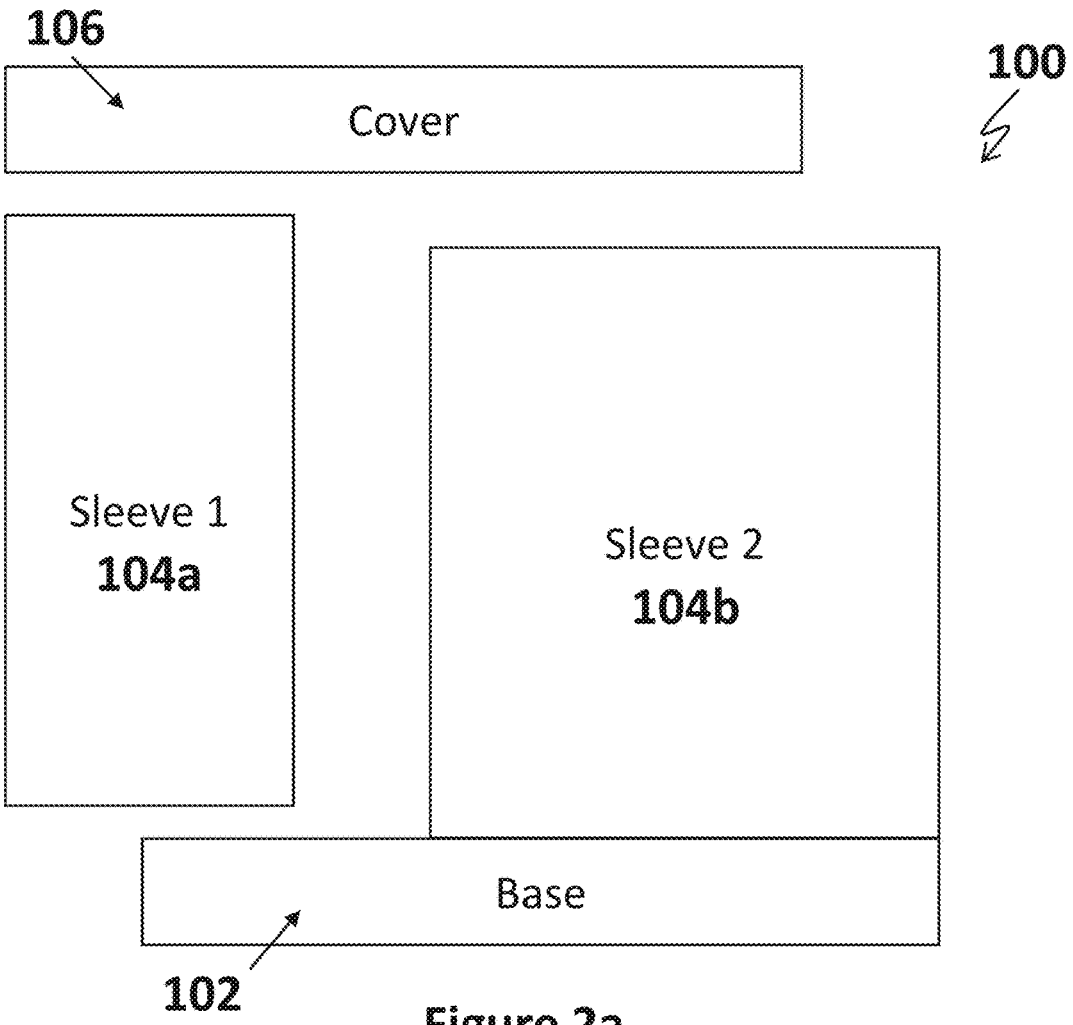
FIGS. 2*a* and 2*b* are schematic overviews of exemplary components of an exemplary transport system in a partially deployed configuration, according to some embodiments of the invention.
Figure 2B:
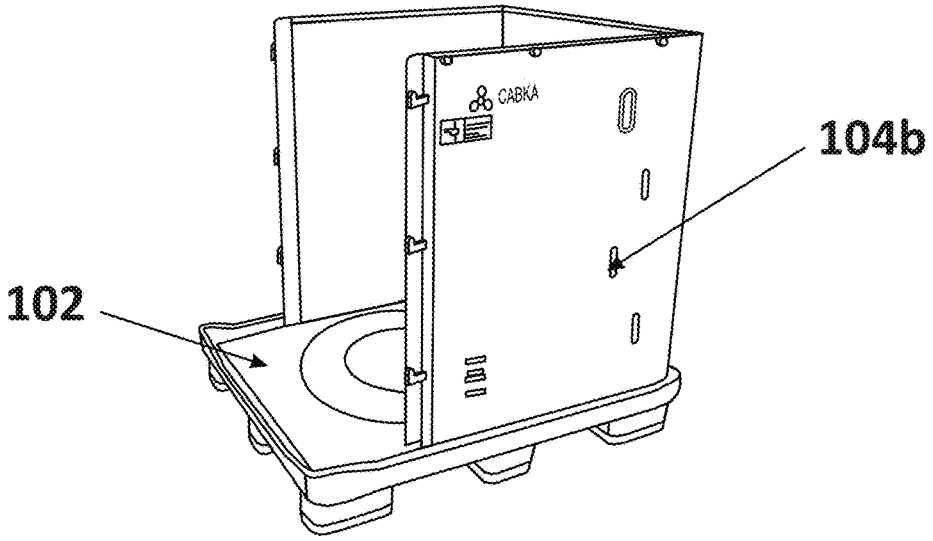

In some embodiments, a partially deployed transport system 100 is as schematically shown for example in FIGS. 2*a-b*, where at least one sleeve (in FIGS. 2*a-b* sleeve 104*b*) is interconnected to the base 102. FIG. 2*a* shows that sleeve 104*a* and cover 106 are not interconnected to the other parts of the transport system 100.

Figure 3A:
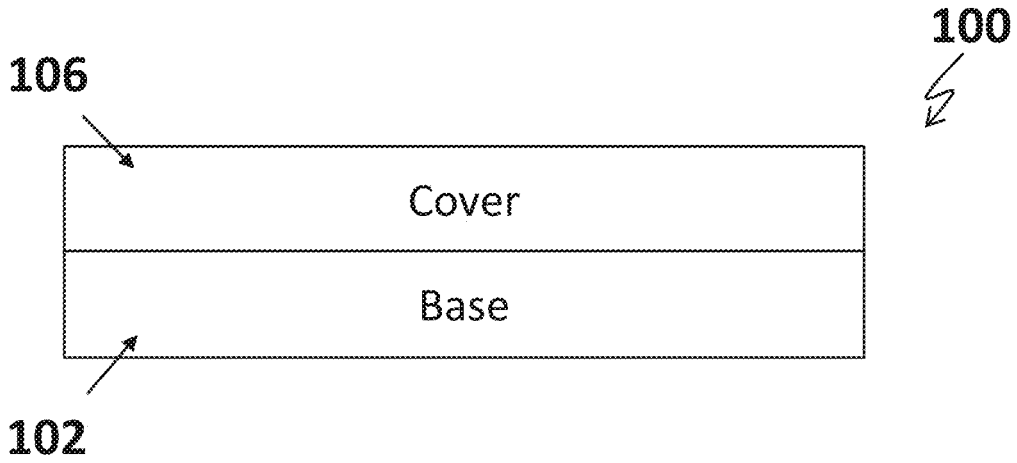
FIGS. 3*a-c* are schematic overviews of exemplary components of an exemplary transport system in a folded configuration, according to some embodiments of the invention.
Figure 3B:
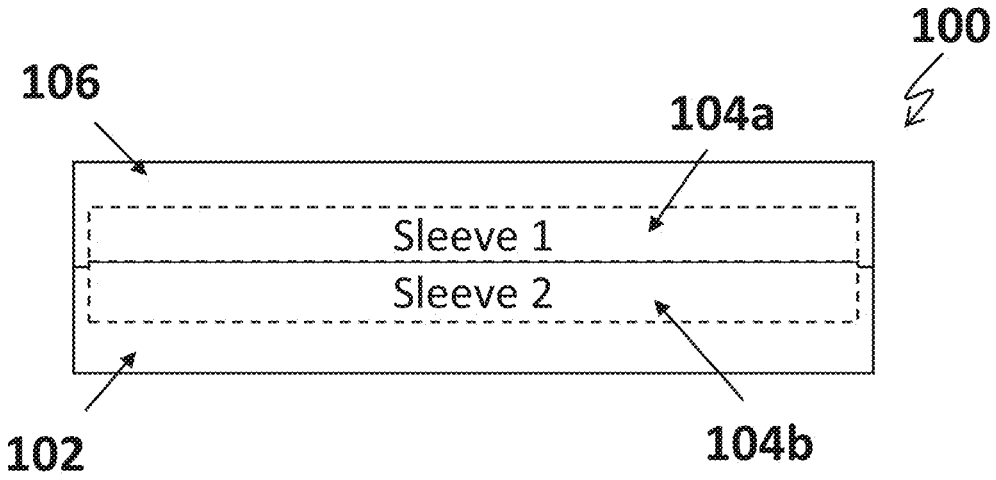
Figure 3C:
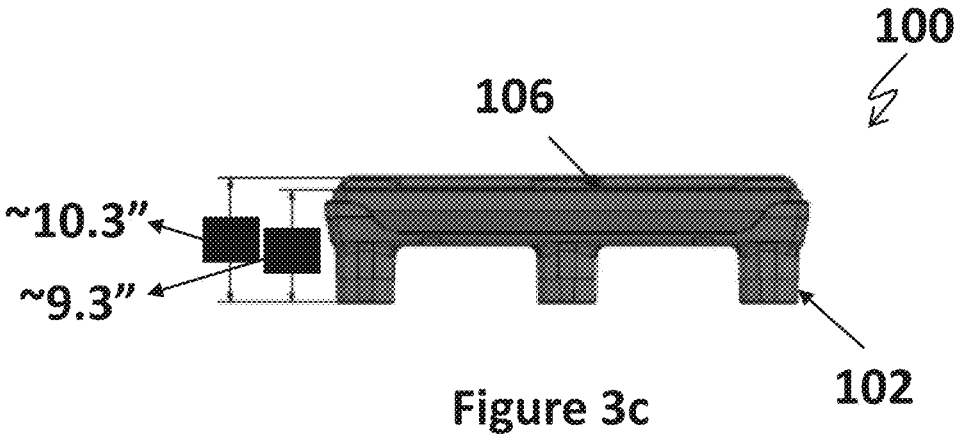

In some embodiments, a folded state is as schematically shown in FIGS. 3*a-c*, where base 102 and cover 106 are interconnected and the sleeves are folded and stored inside base 102 and cover 106. FIG. 3*a* shows base 102 and cover 106 interconnected, while FIG. 3*b* schematically shows the sleeves 104*a-b* folded and stored inside base 102 and cover 106. FIG. 3*c* shows exemplary heights of the system 100 in a folded state. In some embodiments, the total height of the system 100 in a folded state, which comprises the base 102, the folded sleeves on top of the base and the cover 106, is from about 10" (inch) to about 12". Optionally from about 9" to about 13". Optionally from about 8" to about 15". In some embodiments, the total height of the system 100 in a folded state without the cover is from about 9" (inch) to about 10". Optionally from about 8" to about 11". Optionally from about 7" to about 14".

Figure 3D:
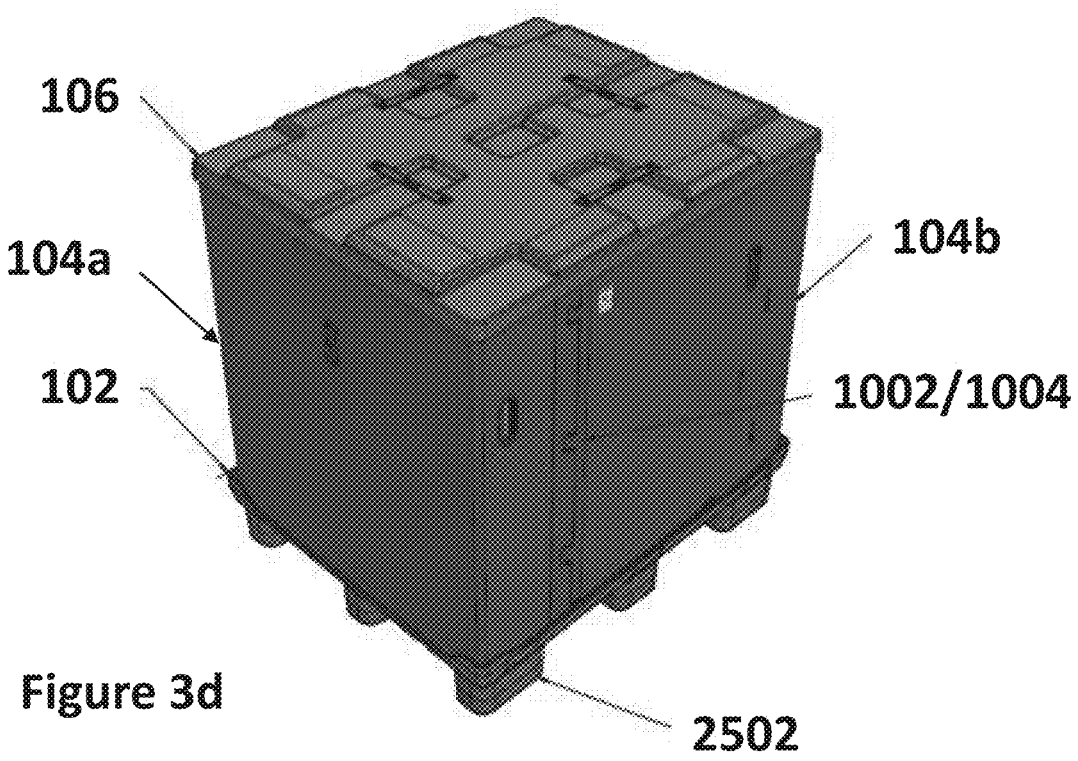
FIGS. 3*d-e* show a comparison between an exemplary transport system in a fully deployed state and an exemplary transport system in a folded state, according to some embodiments of the invention.
Figure 3E:
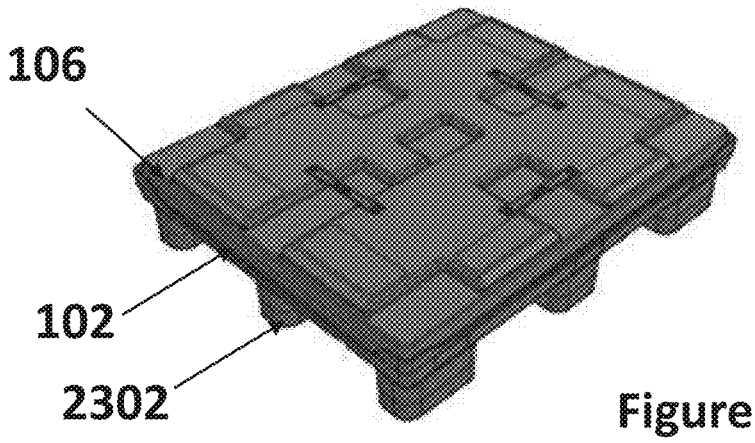

FIGS. 3*d* and 3*e* show a comparison between an exemplary transport system 100 in a fully deployed state (FIG. 3*d*) and an exemplary transport system 100 in a folded state (FIG. 3*e*).

In some embodiments, the components of the transport system 100 are made of recycled materials.

Exemplary Base

Figure 4A:
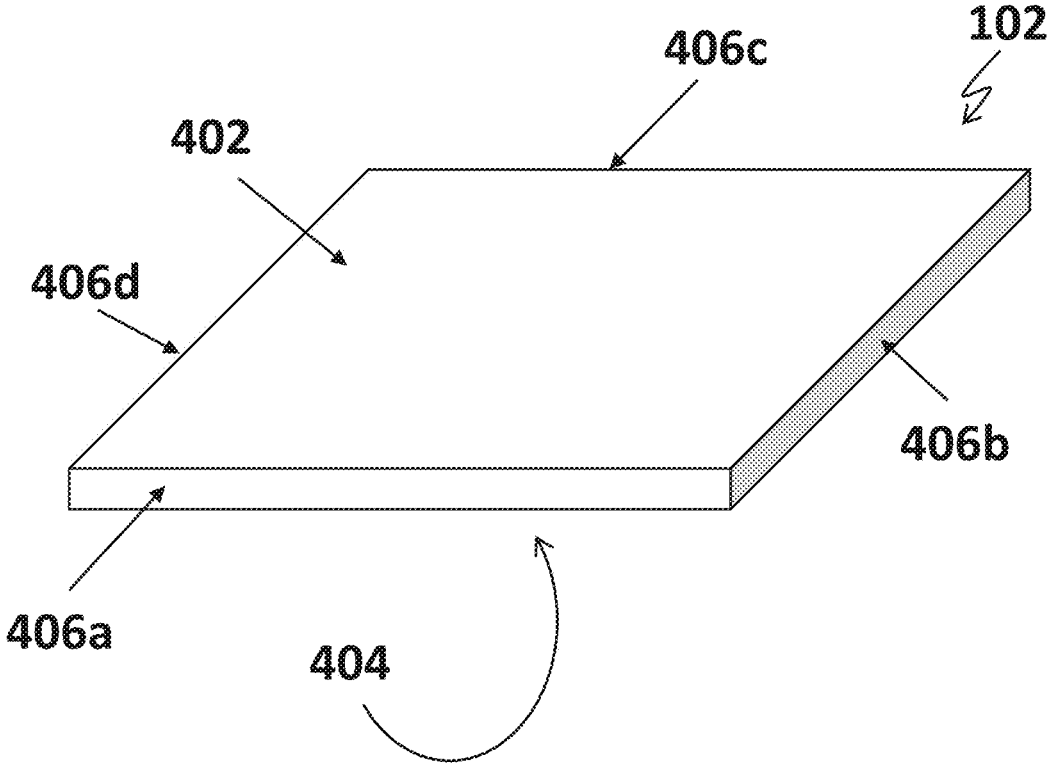
FIGS. 4*a-c* are schematic representations of an exemplary base, according to some embodiments of the invention.
Figure 4B:
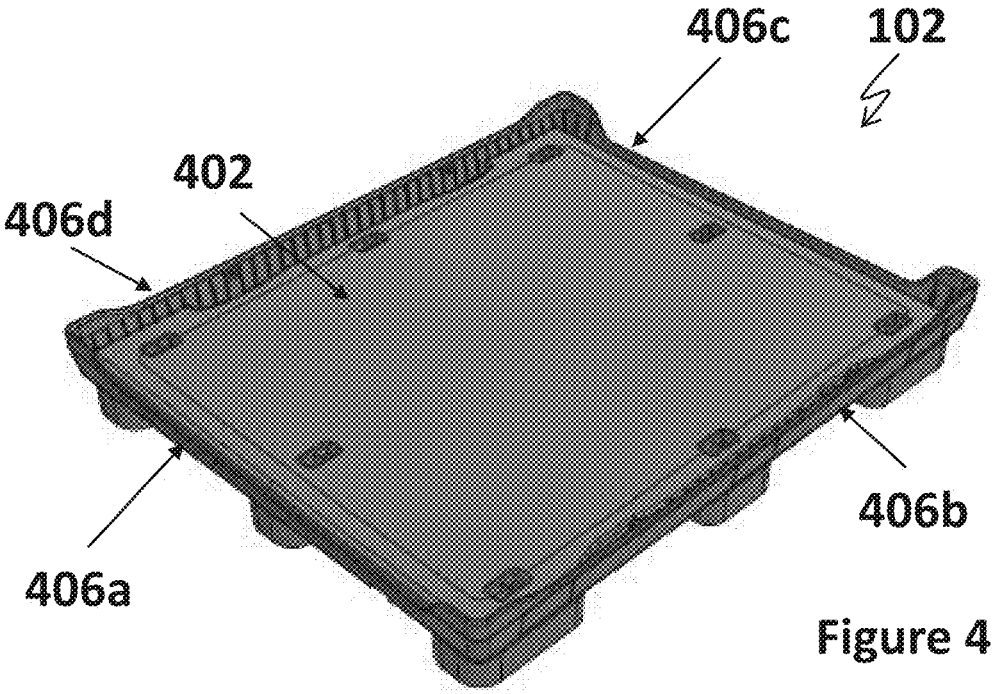
Figure 4C:
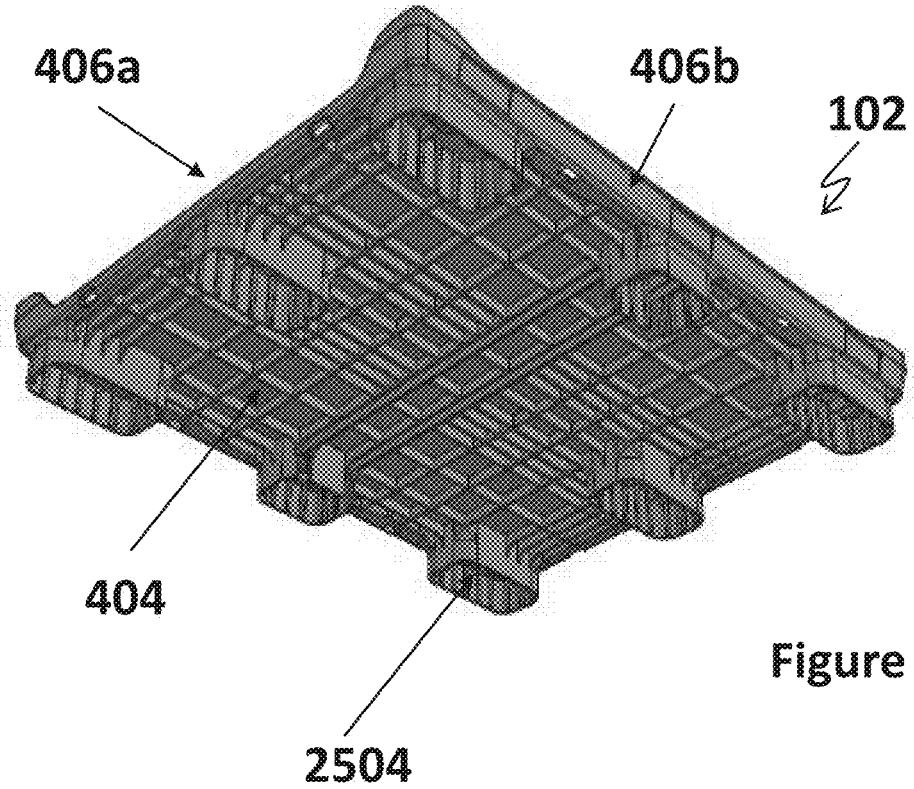

Referring now to FIGS. 4*a-c*, showing a schematic representations of a base, according to some embodiments of the invention. In some embodiments, the base 102 comprises:

1. A top surface 402, comprising the features for reversibly interconnecting the components of the system, on which products, boxes of products, and other objects are stored for storage and/or for transport.

2. A bottom surface 404, which is in contact with an external surface (for example the floor) and/or the external environment where the transport system is located (track, shelf, container, etc.). In some embodiments, the bottom surface 404 comprises features to enable use of a forklift or a hand-lift, for example protrusions, legs, extensions, spaces, etc.

3. Four side surfaces 406*a-d* defining the external periphery of the base 102.

Figures 5A, 5B:
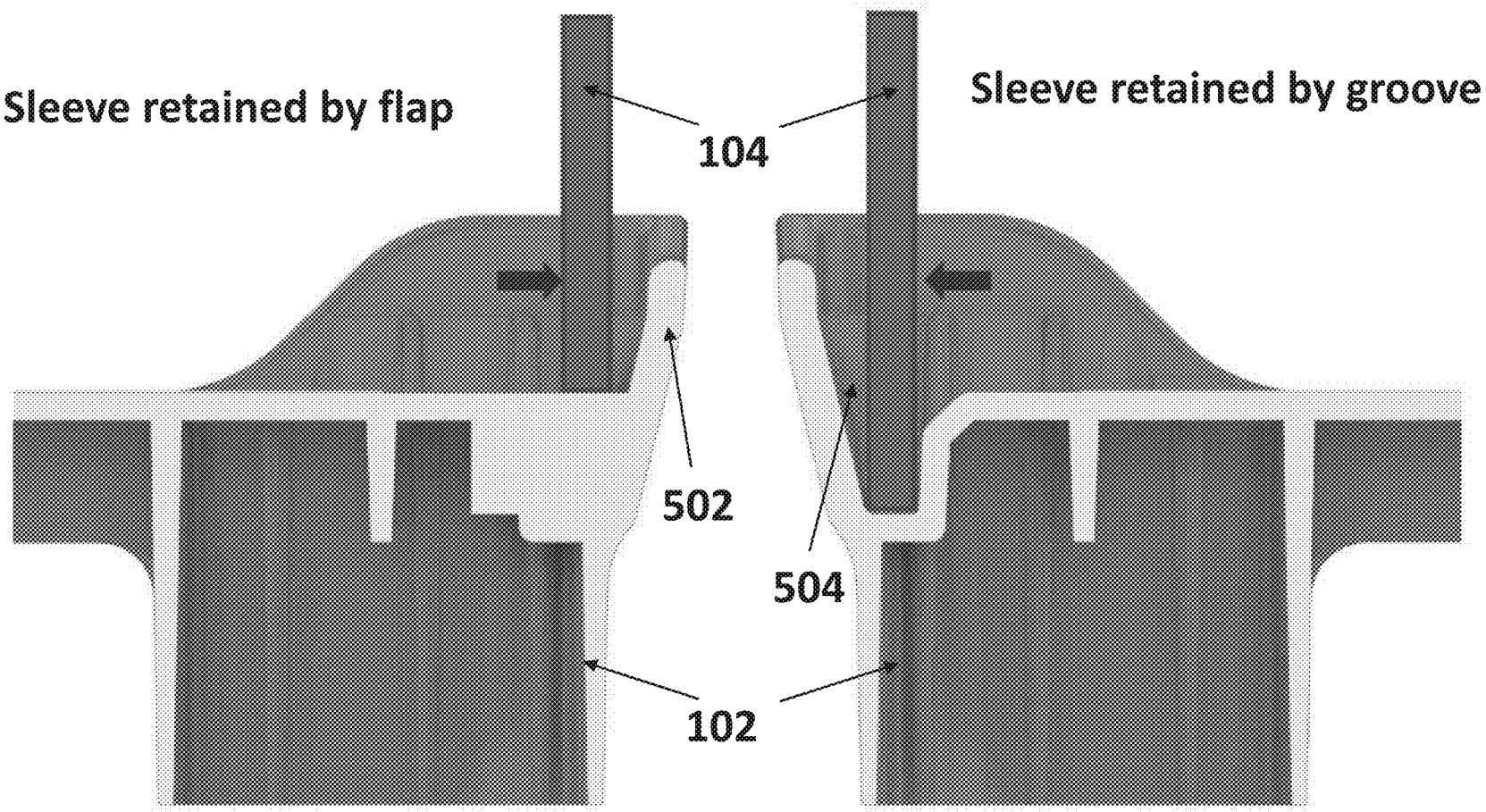
FIGS. 5*a-b* are schematic representations of two different techniques used in the connection between a base and a sleeve, according to some embodiments of the invention.

As mentioned above, each of the components of the transport system 100 comprises features for reversibly interconnecting the components. Typically, in transport systems comprising a base and sleeves, the connection between the base and the sleeve is characterized by mainly two different techniques, retention by flaps and retention by grooves. Referring now to FIGS. 5*a-b*, showing a schematic representation of two different techniques used in the connection between a base and a sleeve, according to some embodiments of the invention. FIG. 5*a* shows a schematic representation of a connection between the sleeve 104 and a base 102, where the sleeve is retained by means of flap 502. In some embodiments, the flap 502 in the base 102 holds the sleeve 104 in place. FIG. 4*b* shows a schematic representation of a connection between the sleeve 104 and a base 102, where the sleeve is retained by means of groove 504. In some embodiments, the groove 504 in the base 102 holds the sleeve 104 in place. In some embodiments, the grooves comprise an inward tapering on at least a part of the external side of the grove, as shown for example in FIG. 17. In some embodiments, a potential advantage of having an inward tapering on at least a part of the external side of the grove is that it allows the user to easily insert the extension inside the groove at an angle and then straighten the sleeve in place.

Figure 6A:
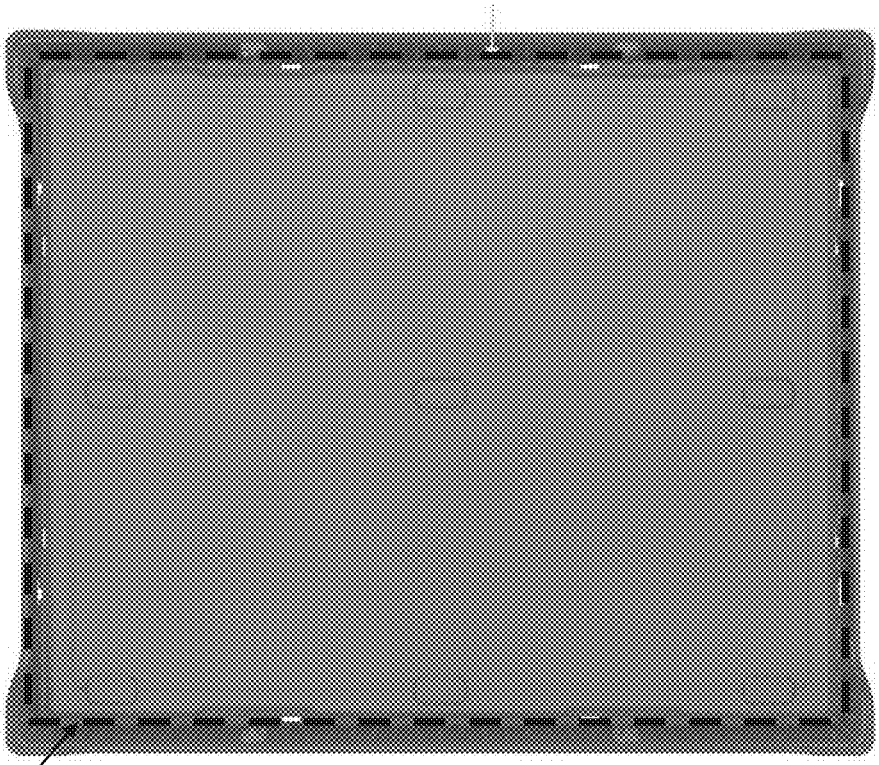
Prior Art Figure 6a
FIGS. 6*a-b* are schematic representations showing a comparison between features in a prior art and an feature in an exemplary base, according to some embodiments of the invention.
Figure 6B:
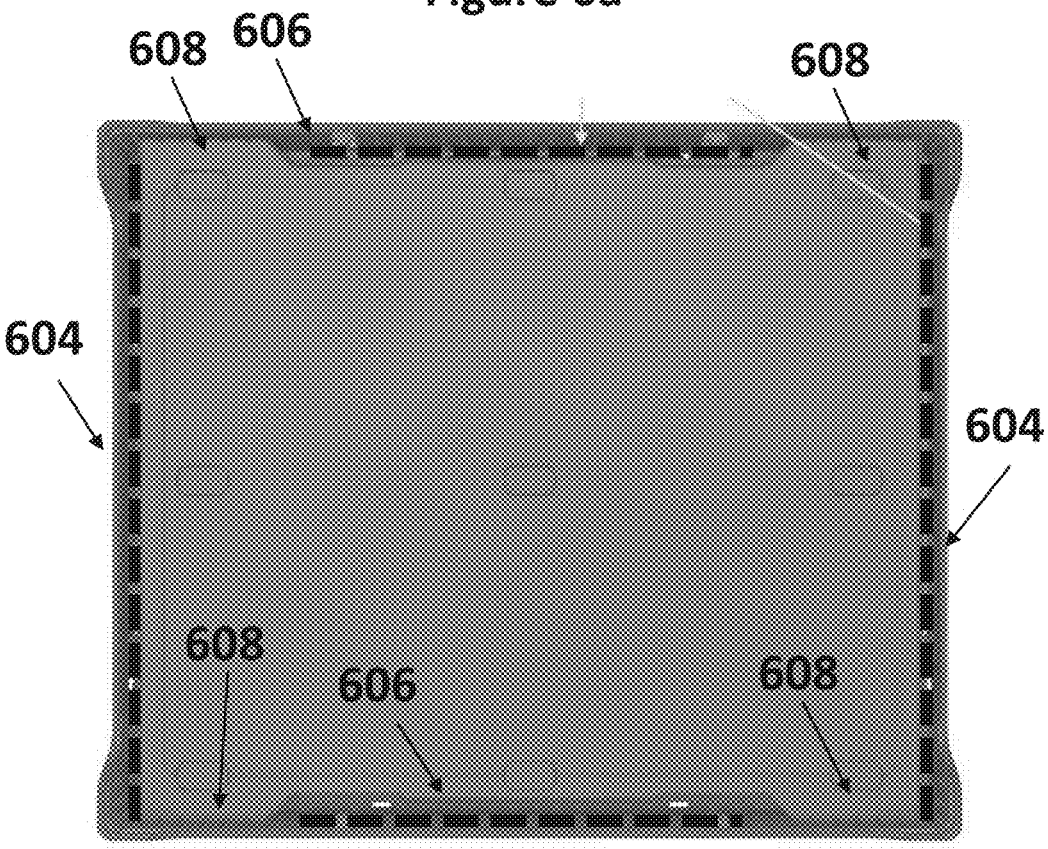

Furthermore, typically, prior art bases utilize one technique of the two mentioned above, as shown for example in FIG. 6*a*. The dotted line 602 in FIG. 6*a* shows that the chosen technique, either flap or groove, in the prior art is the same over the whole periphery of the base; also referred as perimetrically grooved or perimetrically flapped. Referring now to FIG. 6*b*, showing a schematic representation of the features of an exemplary base 102, according to some embodiments of the invention. In some embodiments, the base 102 comprises utilizes both techniques, flaps and grooves, to hold the sleeves. In some embodiments, the features of the base 102 that hold the sleeves are flaps and grooves. In FIG. 6*b*, the zones where there are grooves are shown with dashed lines 604/606. In some embodiments, exemplary grooves 604 extend along the whole front and back sides of the perimeter of the top surface of the base 102. In some embodiments, exemplary grooves 606 partially extend along the side sides of the perimeter of the top surface of the base 102, leaving "un-grooved" parts 608 along the perimeter of the top surface of the base 102. In some embodiments, the base 102 comprises flaps 502 around the whole periphery of the base 102. In some embodiments, flaps 502 are located in some places of the periphery of the base 102.

In some embodiments, exemplary grooves along the periphery of the base are not angle grooves, meaning grooves on the back side and/or on the front side do not meet grooves on neither the right side nor the left side.

In some embodiments, if and when grooves from the back side and/or the front side meet grooves from the right side and/or the left side, thereby generating an angle groove in the corner of the base, the angle in the base comprises a gap on the internal surface of the base thereby cancelling the groove at the angle of the base and generating a hole on the surface of the base. In some embodiments, a potential advantage of cancelling the angle groove in the corner of the base by providing a gap in the corner is that it facilitates the insertion of the extension of the sleeves into the grooves by eliminating the need to coordinate the sleeves into the grooves at the angles.

Figure 7B:
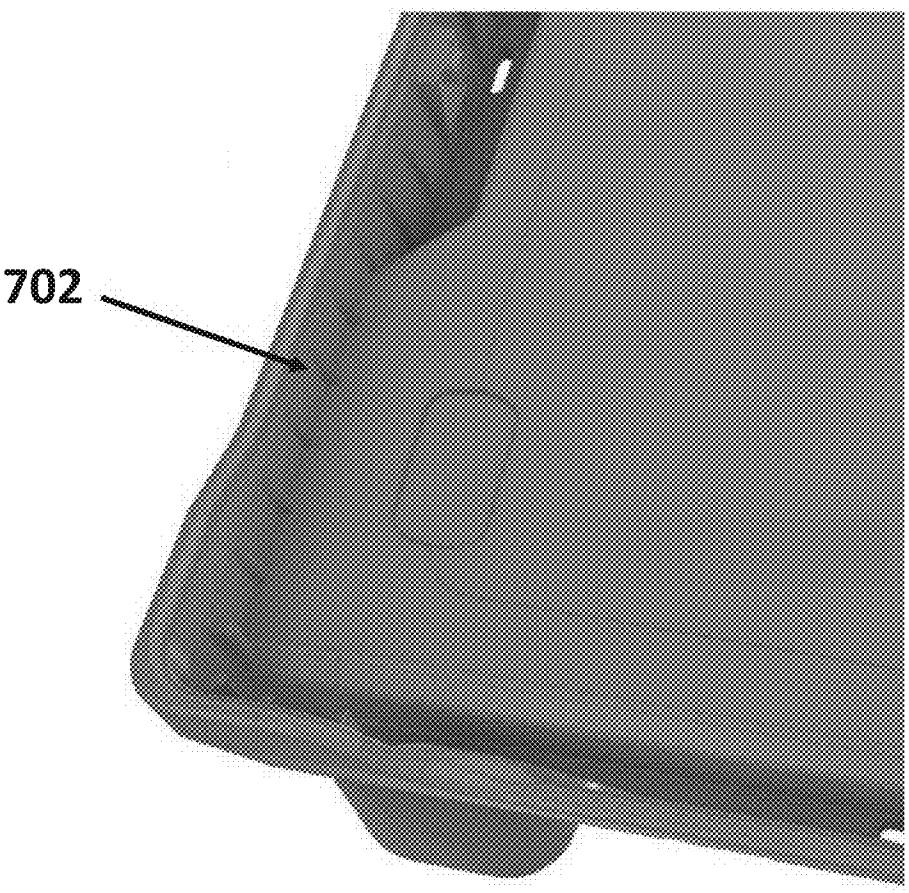
FIGS. 7*a-b* are schematic representations showing a perspective view comparison between features in a prior art and an feature in an exemplary base, according to some embodiments of the invention.
Figure 7A:
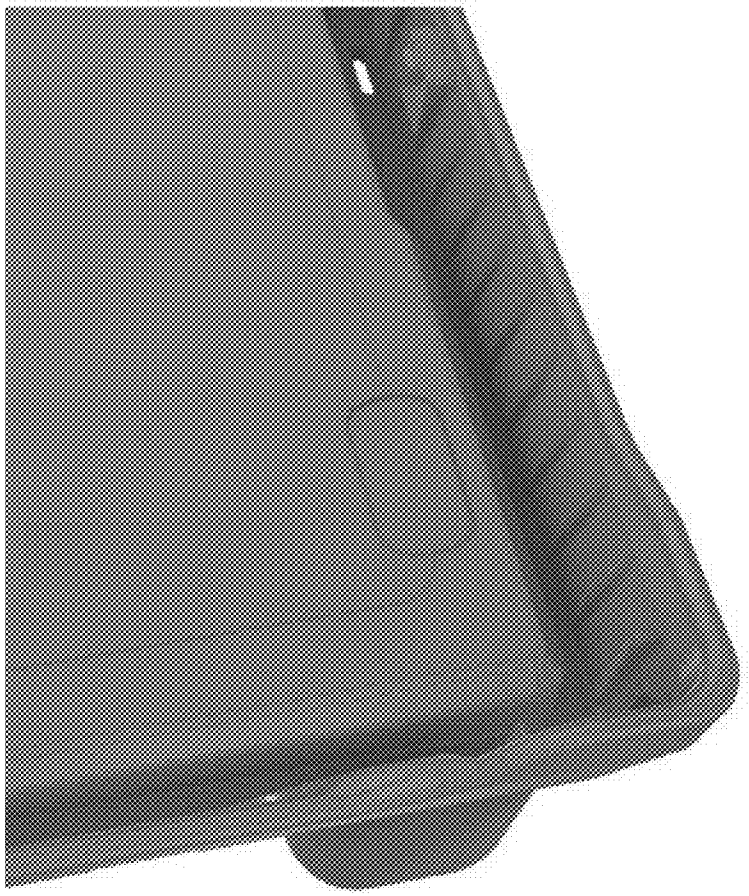

Referring now to FIGS. 7*a-b*, showing a perspective view for comparison of a prior art base with a base of the invention, according to some embodiments of the invention. FIG. 7*a* shows a perimetrically grooved prior art base, while FIG. 7*b* shows a non-perimetrically grooved base. Arrow 702 points to a zone of the base that do not comprises a groove.

Referring now to FIGS. 8*a-b*, showing sizes of exemplary bases, according to some embodiments of the invention. In some embodiments, base 102 comprises one or more sides having a length of from about 40" (inch) to about 50". Optionally from about 35" to about 55". Optionally from about 30" to about 60". In some embodiments, base 102 comprises another one or more sides having a length of from about 35" (inch) to about 45". Optionally from about 25" to about 55". Optionally from about 20" to about 60". In some embodiments, the base comprises measures as shown for example in FIGS. 8*a-b*. It should be understood that these measures are exemplary measures only, provided to allow a person having skills in the art to reproduce the invention. Other measures could be used and should be understood that those are also meant to be included in scope of the invention. In some embodiments, the base comprises an elastic modulus higher than 600 MPa, optionally from about 500 MPa to about 1000 MPa, optionally from about 400 MPa to about 2500 MPa, optionally from about 600 MPa to about 5000 MPa. In some embodiments, the base comprises an IZOD higher than 12 Kj/sqm, optionally from about 10 Kj/sqm to about 30 Kj/sqm, optionally from about 10 Kj/sqm to about 100 Kj/sqm, optionally from about 10 Kj/sqm to about 1000 Kj/sqm. In some embodiments, the base is made of PE having an average thickness of about 0.3".

Exemplary Cover

Figure 9A:
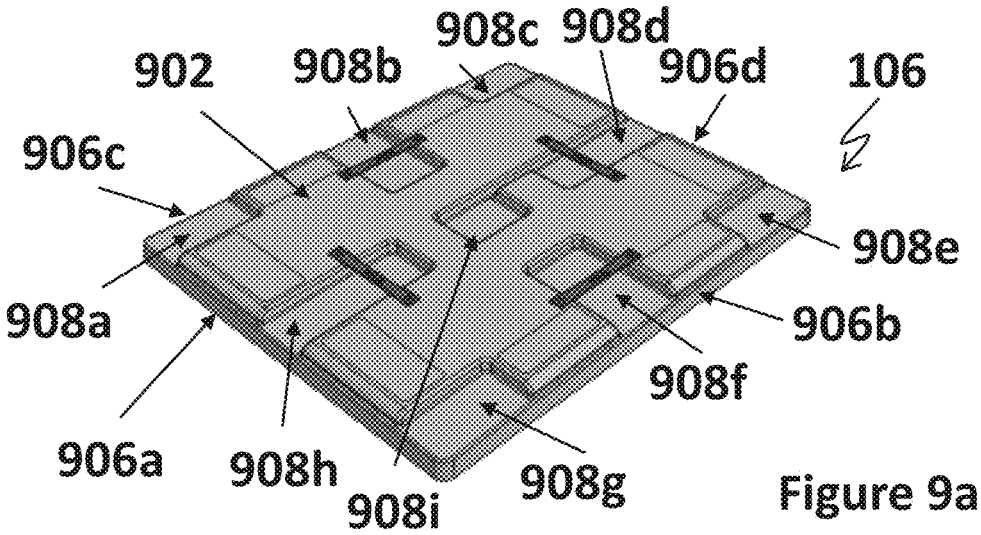
FIGS. 9*a-c* are schematic representations of sizes of exemplary covers, according to some embodiments of the invention.
Figure 9B:
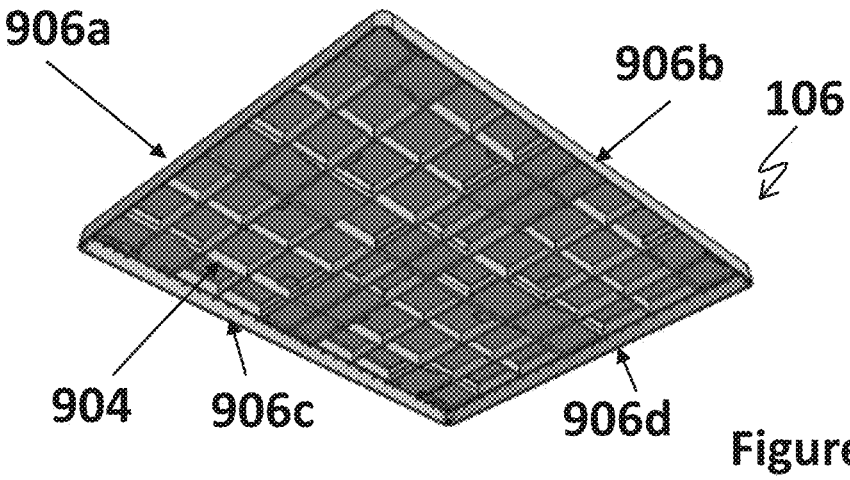
Figure 9C:
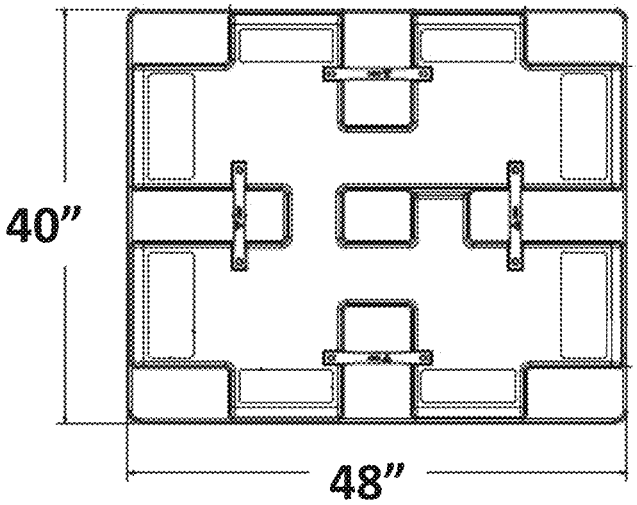

Referring now to FIGS. 9*a-c*, showing schematic representations of exemplary covers, according to some embodiments of the invention. In some embodiments, the cover 106 comprises:

1. A top surface 902, comprising indentations for receiving extension legs or bottom legs from another transport system when one is mounted on top of another.
2. A bottom surface 904.
3. Four side surfaces 906*a-d* defining the external periphery of the cover 106.

Figure 24B:
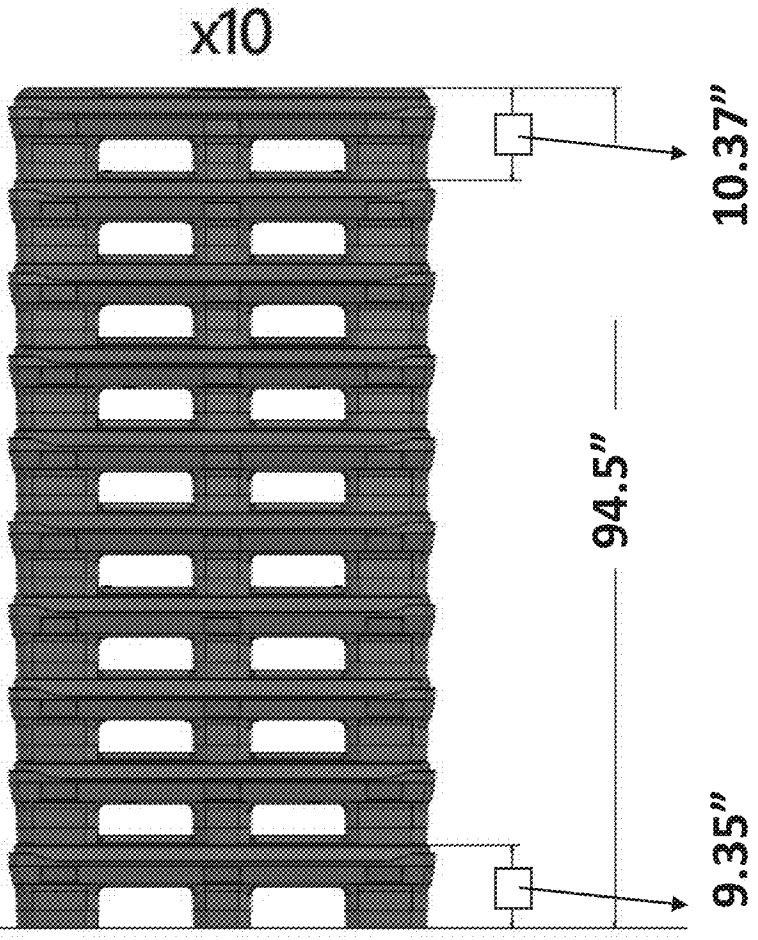
FIGS. 24*a-b* are schematic illustrations of an exemplary transport system stacked, according to some embodiments of the invention.
Figure 24A:
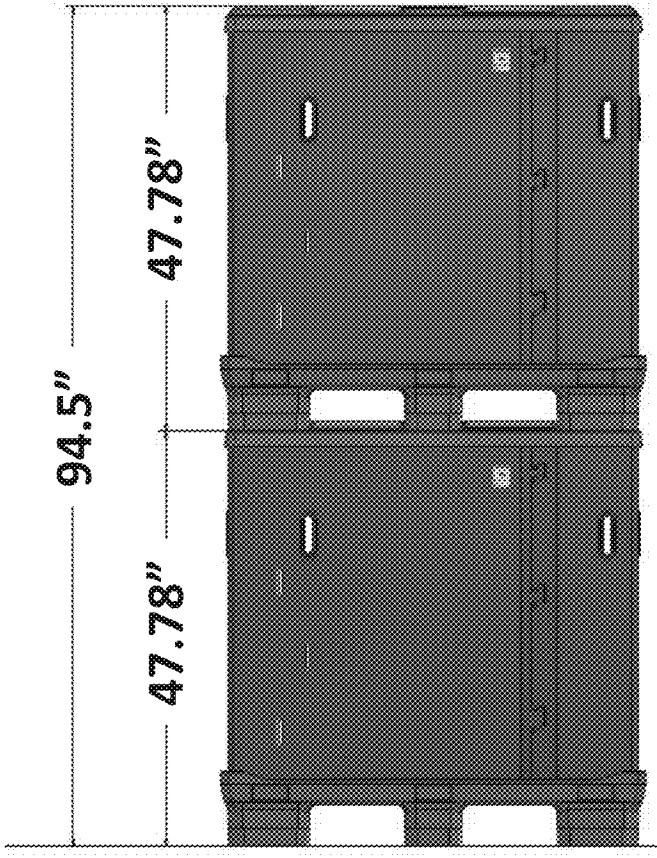

In some embodiments, the top surface 902 of the cover 106 comprises indentations 908*a-i* configured to receive bottom legs of another transport system when two or more transport systems are mounted on top of another (See FIGS. 24*a* and 24*b*).

In some embodiments, the cover comprises measurements as shown for example in FIG. 9*c*. It should be understood that these measures are exemplary measures only, provided to allow a person having skills in the art to reproduce the invention. Other measures could be used and should be understood that those are also meant to be included in scope of the invention. In some embodiments, the cover comprises an elastic modulus higher than 600 MPa, optionally from about 500 MPa to about 1000 MPa, optionally from about 400 MPa to about 2500 MPa, optionally from about 600 MPa to about 5000 MPa. In some embodiments, the cover comprises an IZOD higher than 12 Kj/sqm, optionally from about 10 Kj/sqm to about 30 Kj/sqm, optionally from about 10 Kj/sqm to about 100 Kj/sqm, optionally from about 10 Kj/sqm to about 1000 Kj/sqm. In some embodiments, the cover is made of PE having an average thickness of about 0.22".

Exemplary Sleeves

Figure 10:
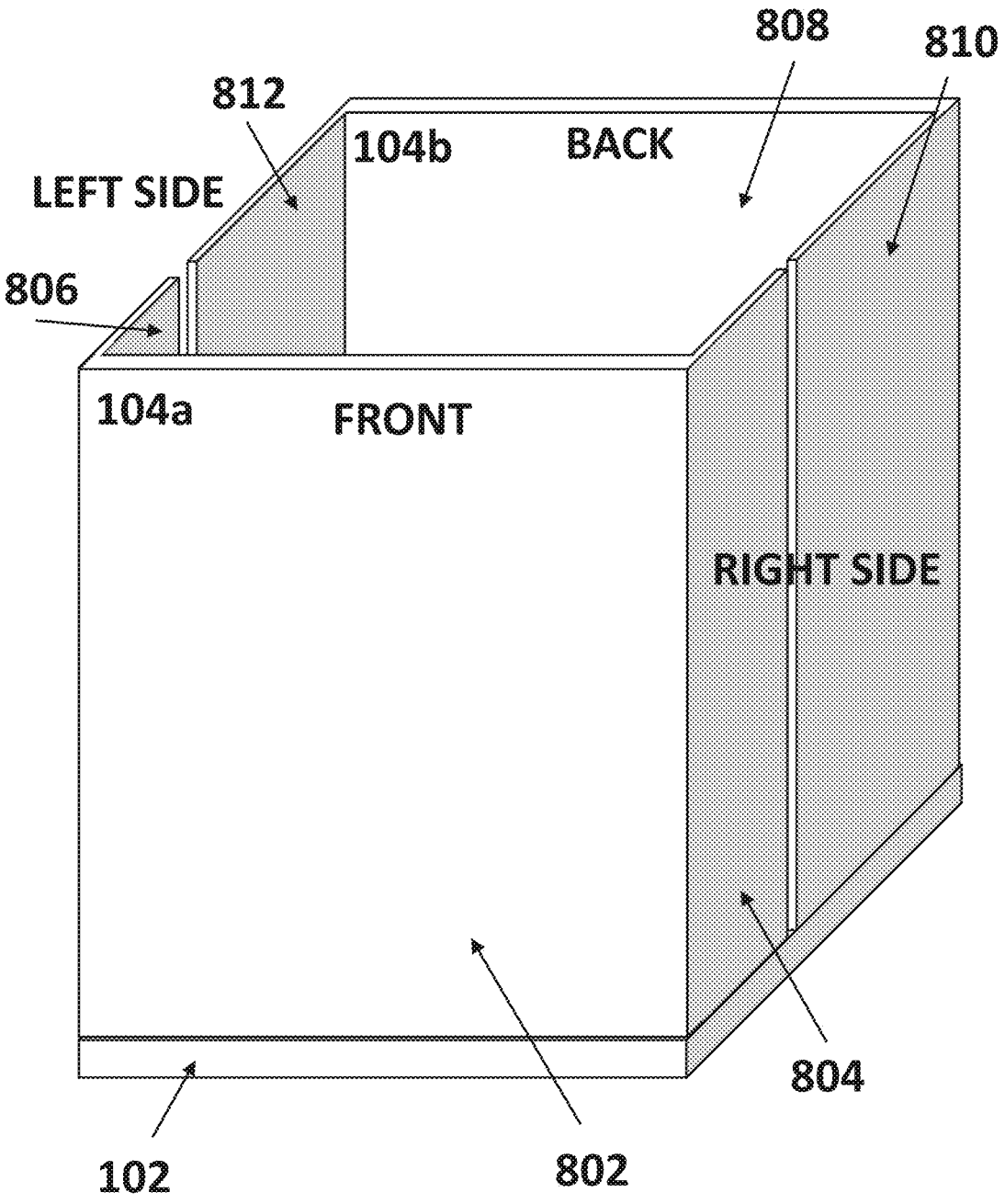
FIG. 10 is a schematic representation of exemplary sleeves with a base, according to some embodiments of the invention.

In some embodiments, one or more sleeves are used in the transport system. In some embodiments, two or more sleeves are used in the transport system. In some embodiments, when more than one sleeve is used, the sleeves are identical. In some embodiments, when more than one sleeve is used, the sleeves are different from each other. Referring now to FIG. 10, schematically showing exemplary sleeves with a base, according to some embodiments of the invention. In a preferred embodiment, two sleeves (104*a-b*) are used in the transport system 100. In some embodiments, the transport system 100 is arranged so there is a front sleeve 104*a* and a back sleeve 104*b*. In some embodiments, front sleeve 104*a* comprises a front surface 802, a front right side surface 804 and a front left side surface 806 (also referred as front C-shape sleeve). In some embodiments, back sleeve 104*b* comprises a back surface 808, a back right side surface 810 and a back left side surface 812 (also referred as back C-shape sleeve). In some embodiments, front surface 802 and back surface 808 extend along the entire length of the base 102, on the front side and on the back side, respectively. In some embodiments, front right side surface 804, front left side surface 806, back right side surface 810 and back left side surface 812 each partially extend along the right side and left side respectively of the periphery of the base 102.

In some embodiments, front right side surface 804 and back right side surface 810 are configured to cover the entire perimeter of the right side of the base 102. In some embodiments, front right side surface 804 and back right side surface 810 comprise an overlapping area where the two meet. In some embodiments, the side of front right side surface 804 and the side of the back right side surface 810 both comprise a feature that complement each other to perform a reversible interconnection between front right side surface 804 and back right side surface 810 where the two meet (see below exemplary reversible holder and FIGS. 13*a-b*).

Similarly to the abovementioned, in some embodiments, front left side surface 806 and back left side surface 812 are configured to cover the entire perimeter of the right side of the base 102. In some embodiments, front left side surface 806 and back left side surface 812 comprise an overlapping area where the two meet. In some embodiments, the side of front left side surface 806 and the side of the back left side surface 812 both comprise a feature that complement each other to perform a reversible interconnection between front left side surface 806 and back left side surface 812 where the two meet (see below exemplary reversible holder and FIGS. 13*a-b*).

In some embodiments, front right side surface 804, front left side surface 806, back right side surface 810 and back left side surface 812 are configured to fold on front surface 802 and back surface 808, respectively.

Figure 11:
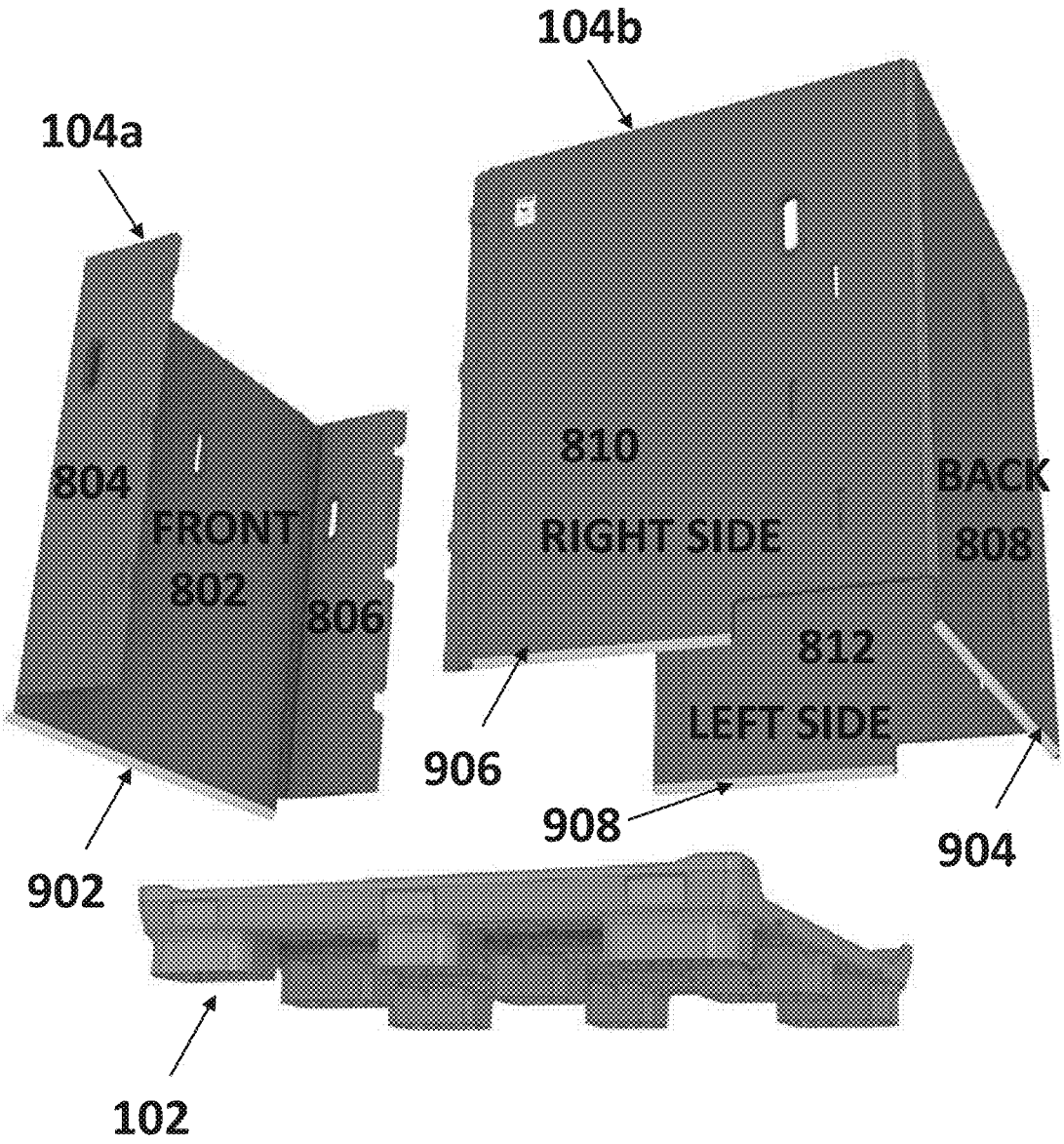
FIG. 11 is a schematic representation of exemplary features for reversibly interconnecting the components of the transport system, according to some embodiments of the invention.

In some embodiments, back right side surface 810 and back left side surface 812 are wider than front right side surface 804 and front left side surface 806, as shown for example in FIGS. 10 and 11.

In some embodiments, whether one sleeve is used or a plurality of sleeves are used or some surfaces are wider than others, the sleeve(s) cover the whole perimeter of the base, thereby enclosing the area above the surface of the base.

Referring now to FIG. 11, showing exemplary features for reversibly interconnecting the components of the transport system 100, according to some embodiments of the invention. In some embodiments, the sleeves comprise one or more extensions of the surfaces. In some embodiments, the one or more extensions extend along the whole surface. In some embodiments, the one or more extensions extend partially along the surfaces.

In some embodiments, front sleeve 104*a* comprises 3 surfaces, front surface 802, front right side surface 804 and front left side surface 806. It can be seen that front surface 802 comprises an extension 902, while front right side surface 804 and front left side surface 806 do not. Furthermore, it can be seen in this example that the extension 902 extends along the whole surface of the bottom part of the front surface 802. In some embodiments, extension 902 of the front surface 802 enters and/or is inserted, for example, into groove 604 (seen in base 102 in FIG. 6*b*), while front right side surface 804 and front left side surface 806 that do not comprise extensions lay on top of un-grooved sections 608 and are optionally held in place by flaps 502.

In some embodiments, back sleeve 104*b* comprises 3 surfaces, a back surface 808, a back right side surface 810 and a back left side surface 812. It can be seen that back surface 808 comprises an extension 904, while back right side surface 810 and back left side surface 812 each comprise an extension 906/908 that partially extends along bottom part of the respective surfaces. Furthermore, it can be seen in this example that the extension 904 extends along the whole surface of the bottom part of the back surface 808. In some embodiments, extension 904 of the back surface 808 enters and/or is inserted, for example, into groove 604 (seen in base 102 in FIG. 6*b*), while the extensions in the back right side surface 810 and a back left side surface 812 enter and/or are inserted, for example, into grooves 606 (seen in base 102 in FIG. 6*b*), and the parts not comprising extensions lay on top of un-grooved sections 608 and are optionally held in place by flaps 502.

In some embodiments, base and sleeves are manufactured so as to match between grooves and extensions. In some embodiments, there are one or more extensions and one or more of matching grooves.

Figure 12:
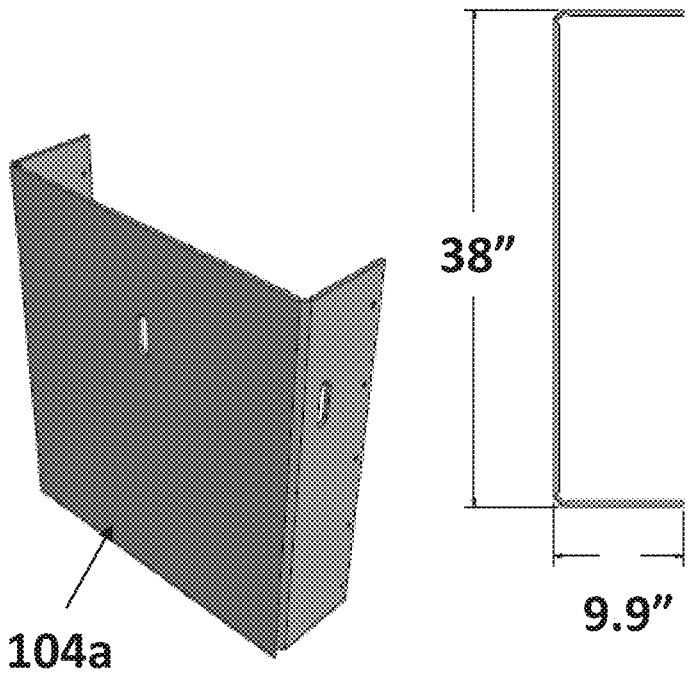
FIG. 12 is a schematic representation of exemplary measurements of an exemplary sleeve, according to some embodiments of the invention.

In some embodiments, the sleeves comprise measurements as shown for example in FIG. 12. It should be understood that these measures are exemplary measures only, provided to allow a person having skills in the art to reproduce the invention. Other measures could be used and should be understood that those are also meant to be included in scope of the invention. In some embodiments, the cover is made of Polypropylene panel having an average thickness of from about 0.39" to about 0.43"; and a density of about equal or higher than 3000 gr/sm.

Exemplary Reversible Holder

Figure 13A:
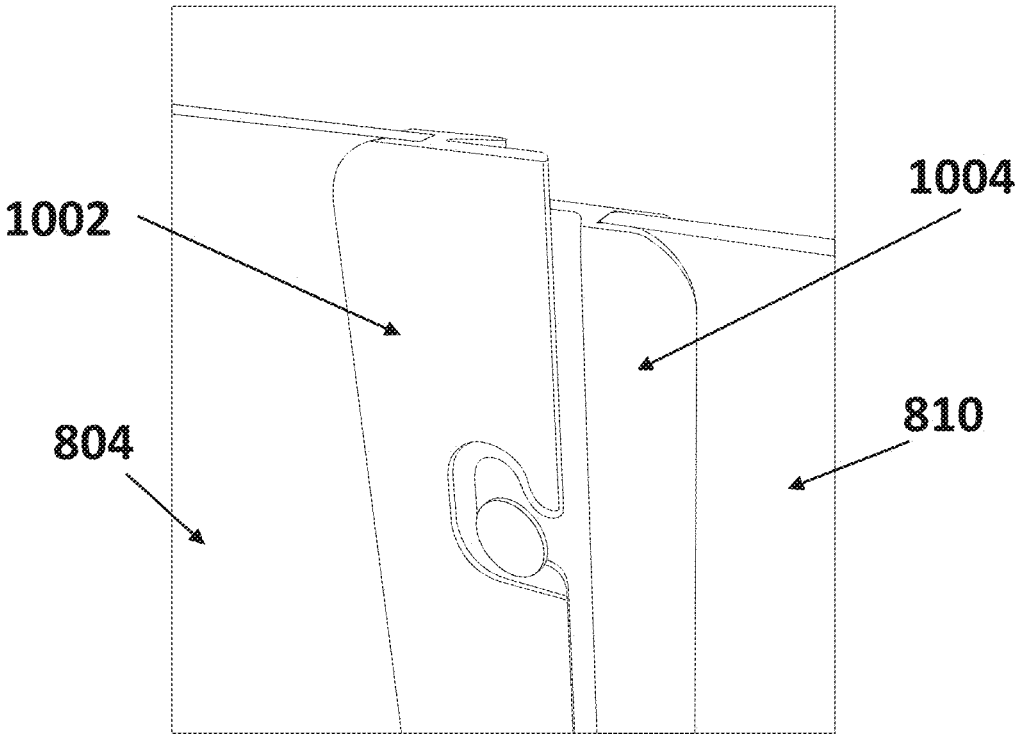
FIGS. 13*a-b* are schematic representations of exemplary holders, according to some embodiments of the invention.
Figure 13B:
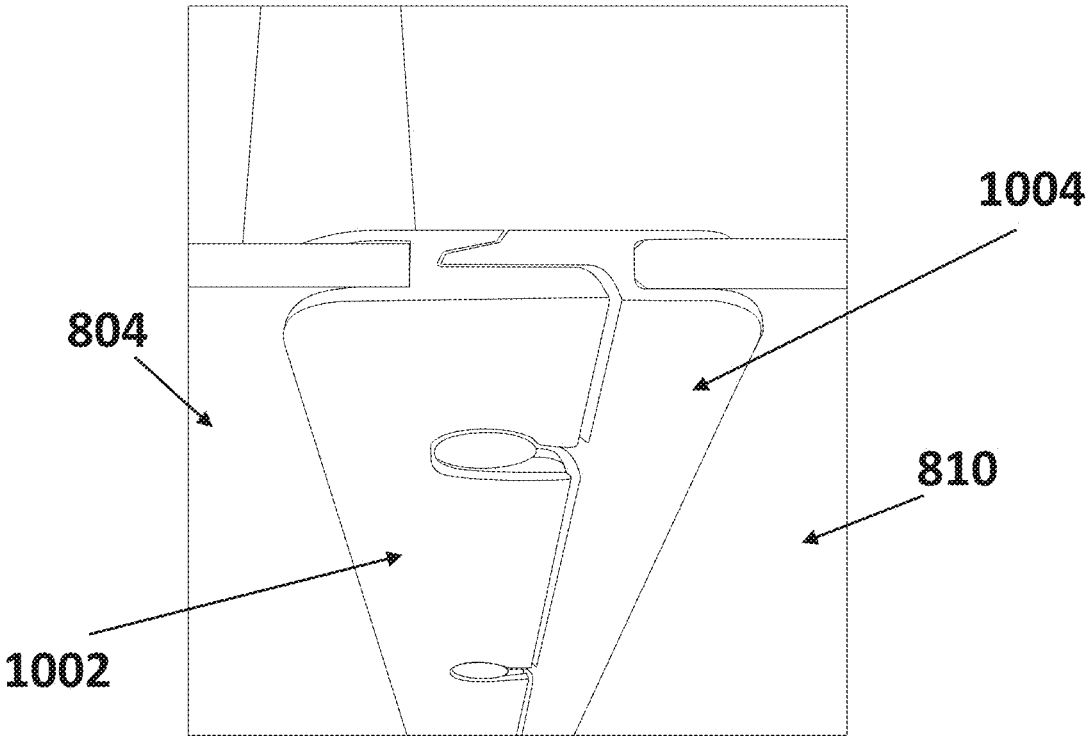

In some embodiments, front sleeve 104*a* and back sleeve 104*b* each comprise an element that are complementary to each other. In some embodiments, when the two elements are interconnected, they reversibly hold the two sleeves together. Referring now to FIGS. 13*a-b*, showing schematic representations of exemplary holders, according to some embodiments of the invention. In some embodiments, along the vertical ends of the front right side surface 804 and the front left side surface 806 there are first sides of the exemplary reversible holder 1002. In some embodiments, along the vertical ends of back right side surface 810 and back left side surface 812 there are second sides of the exemplary reversible holder 1004. In some embodiments, the reversible holders 1002/1004 extend along the whole vertical end of the sleeves. A potential advantage of extending along the whole vertical end of the sleeves is that it potentially ensures that the sleeves will stay attached during transport and that the contents of the transport system will not exit the system during transport. In some embodiments, the reversible holders 1002/1004 only extend partially along the vertical end of the sleeves and/or are located in several places along the vertical end of the sleeves. In some embodiments, the mechanism of the exemplary reversible holder is as shown in FIGS. 13*a-b*, which is male-female interlocking structure where the female structure comprises an "L" shape where the male structure slides therein. The inventors have found that this locking mechanism is very effective and easy to operate in comparison to other mechanisms, as will be further explained below in the methods section. In some embodiments, the reversible holding mechanism is other than the one disclosed in FIGS. 13*a-b*. In some embodiments, the reversible holding mechanism is one or more of Velcro, snaps and mechanical elements.

In some embodiments, the reversible holding mechanism comprises an elastic modulus of about 1800 MPa, optionally from about 1500 MPa to about 2000 MPa, optionally from about 1000 MPa to about 3000 MPa, optionally from about 2000 MPa to about 5000 MPa. In some embodiments, the reversible holding mechanism comprises an IZOD of about 180 Kj/sqm, optionally from about 100 Kj/sqm to about 250 Kj/sqm, optionally from about 150 Kj/sqm to about 500 Kj/sqm, optionally from about 180 Kj/sqm to about 1000 Kj/sqm. In some embodiments, the reversible holding mechanism is made of PE having an average thickness of about 0.11".

Exemplary Methods

Figure 14:
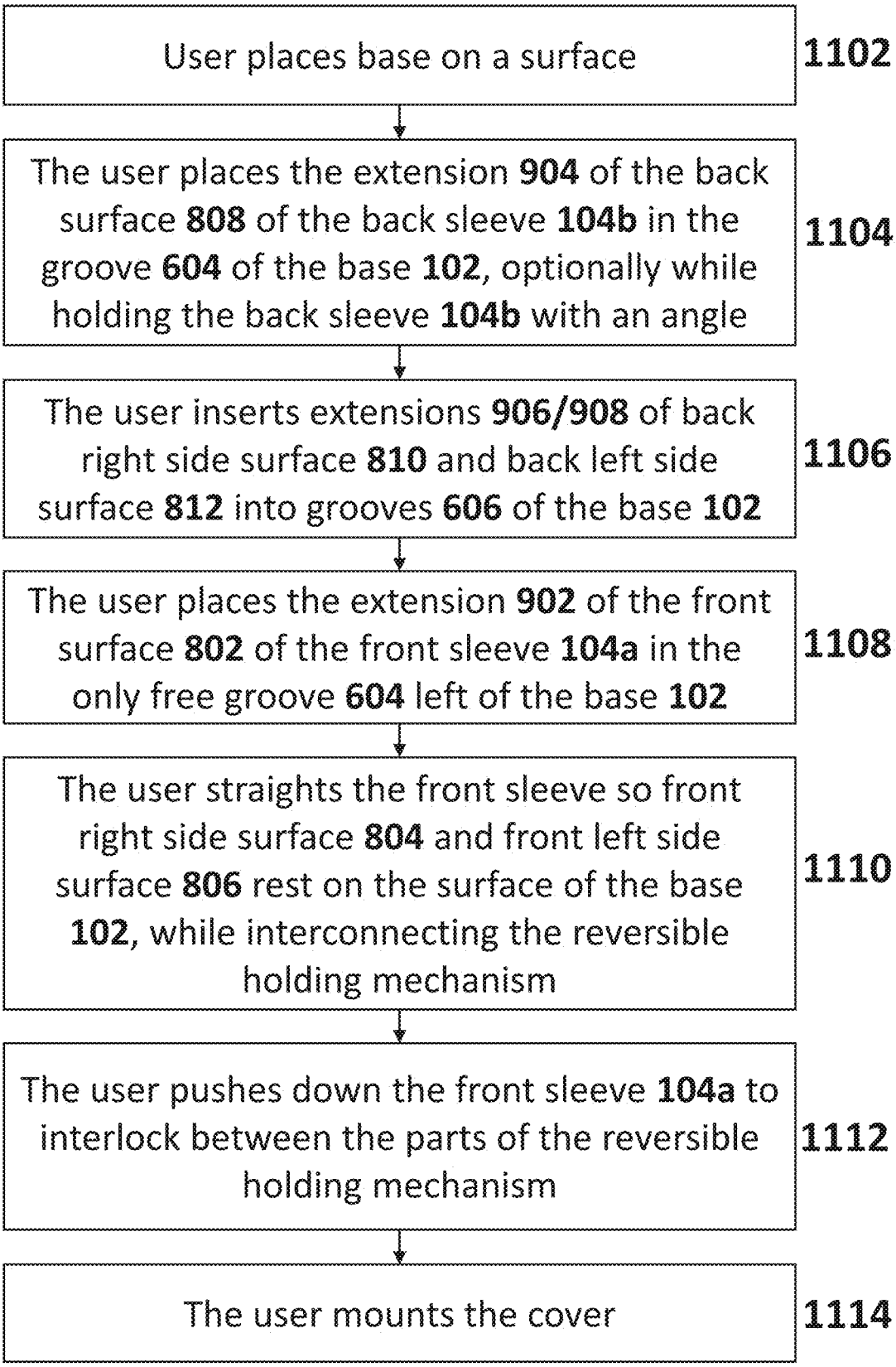
FIG. 14 is a schematic flowchart of an exemplary method of mounting the transport system, according to some embodiments of the invention.
Figure 15:
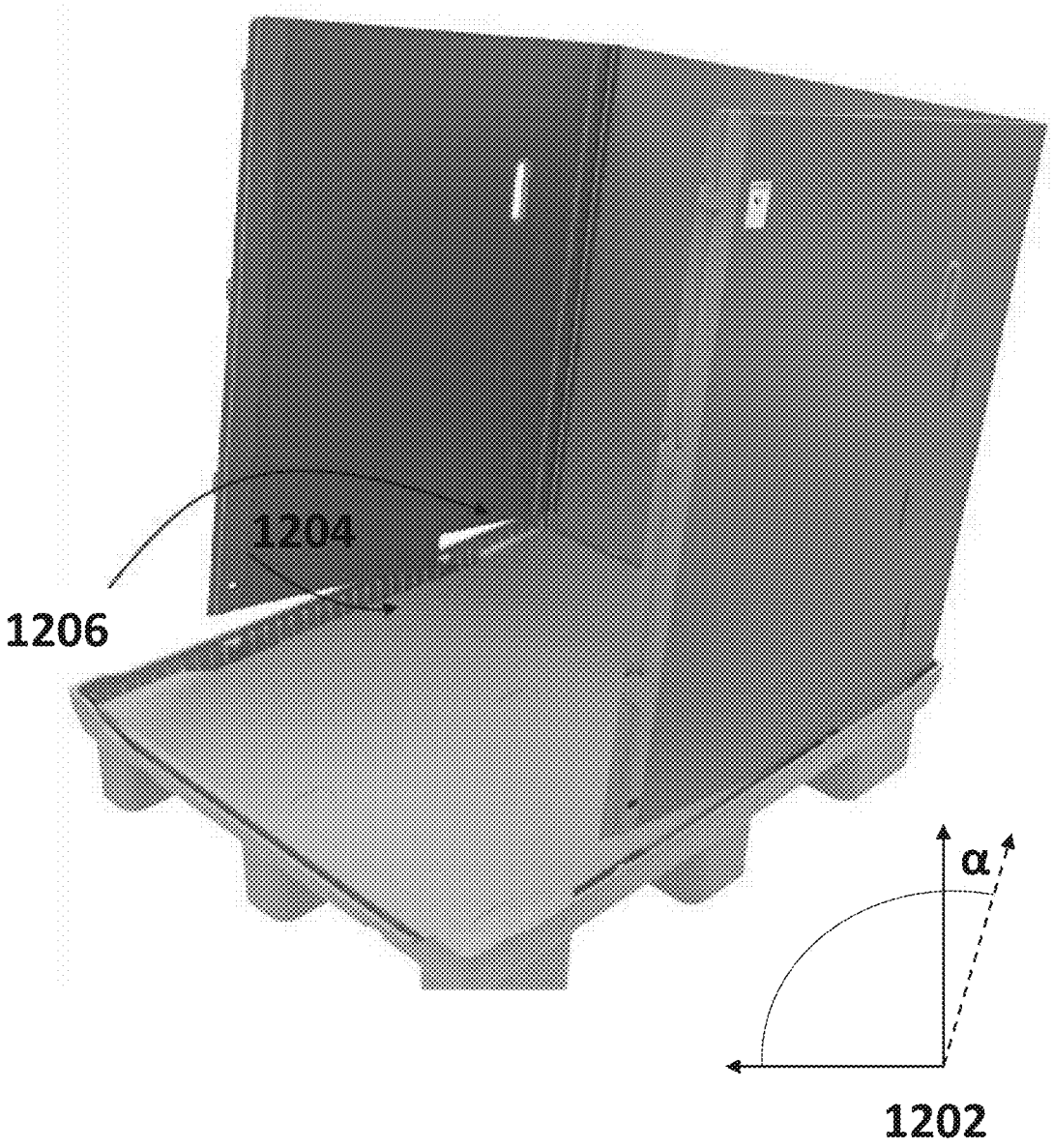
FIG. 15 is a schematic illustration of an exemplary part of the exemplary method of mounting the transport system, according to some embodiments of the invention.

Referring now to FIG. 14, showing a schematic flowchart of an exemplary method of mounting the transport system, according to some embodiments of the invention. In some embodiments, the transport system is mounted as following:

1. The user places the base on a surface, for example a floor (1102);

2. The user places the extension 904 of the back surface 808 of the back sleeve 104*b* in the groove 604 of the base 102 (1104), optionally while holding the back sleeve 104*b* in an angle (denoted α) 1202 as shown for example in FIG. 15. A potential advantage of holding the back sleeve 104*b* at an angle is that it allows an easy insertion of the sleeve in place without applying unnecessary forces and/or pressure on the sleeve, for example in location 1206 shown in FIG. 15, when inserting 1204 the side extensions in the side grooves. In some embodiments, the grooves comprise an inward tapering on at least a part of the external side of the grove, as shown for example in FIG. 16. In some embodiments, a potential advantage of having an inward tapering on at least a part of the external side of the grove is that it allows the user to easily insert the extension inside the groove at an angle as explained above. In some embodiments, taking out the sleeve is done the same way, first the user moves the sleeve backwards to provide an angle to the sleeve in relation to the base, and then the user takes out the sleeve from the base, as will be further disclosed below.

Figure 19:
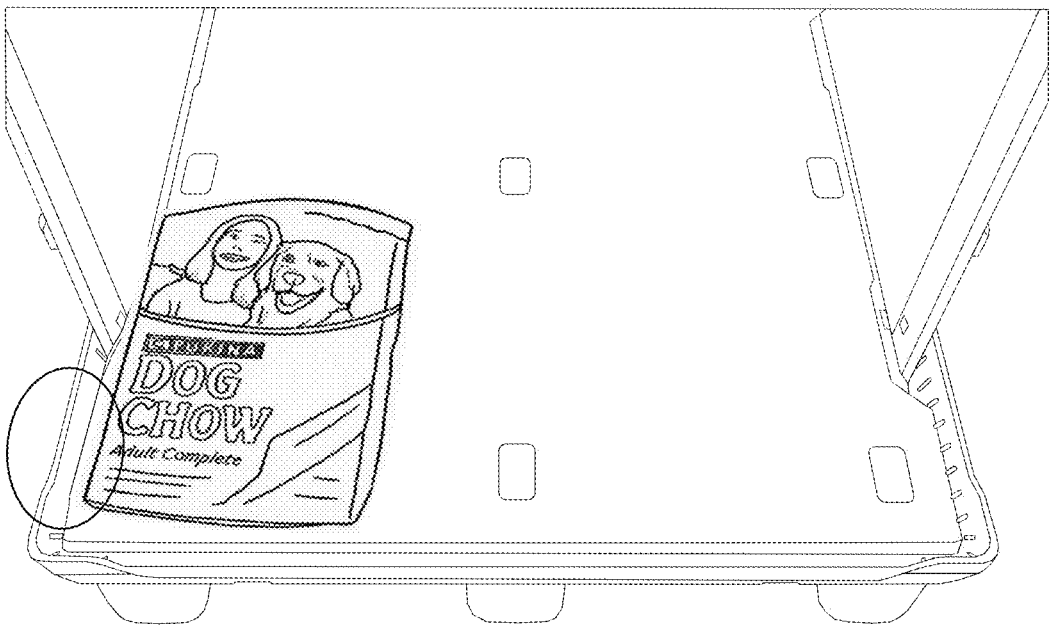
FIG. 19 is a picture of an exemplary transport system left for storing purposes, according to some embodiments of the invention.

3. The user inserts extensions 906/908 of back right side surface 810 and back left side surface 812 into grooves 606 of the base 102 (1106). In some embodiments, at this point, the system looks like in FIGS. 2*a* and 2*b*. In some embodiments, the system can be left at this point for storing purposes, as shown for example in FIG. 19.

Figure 16:
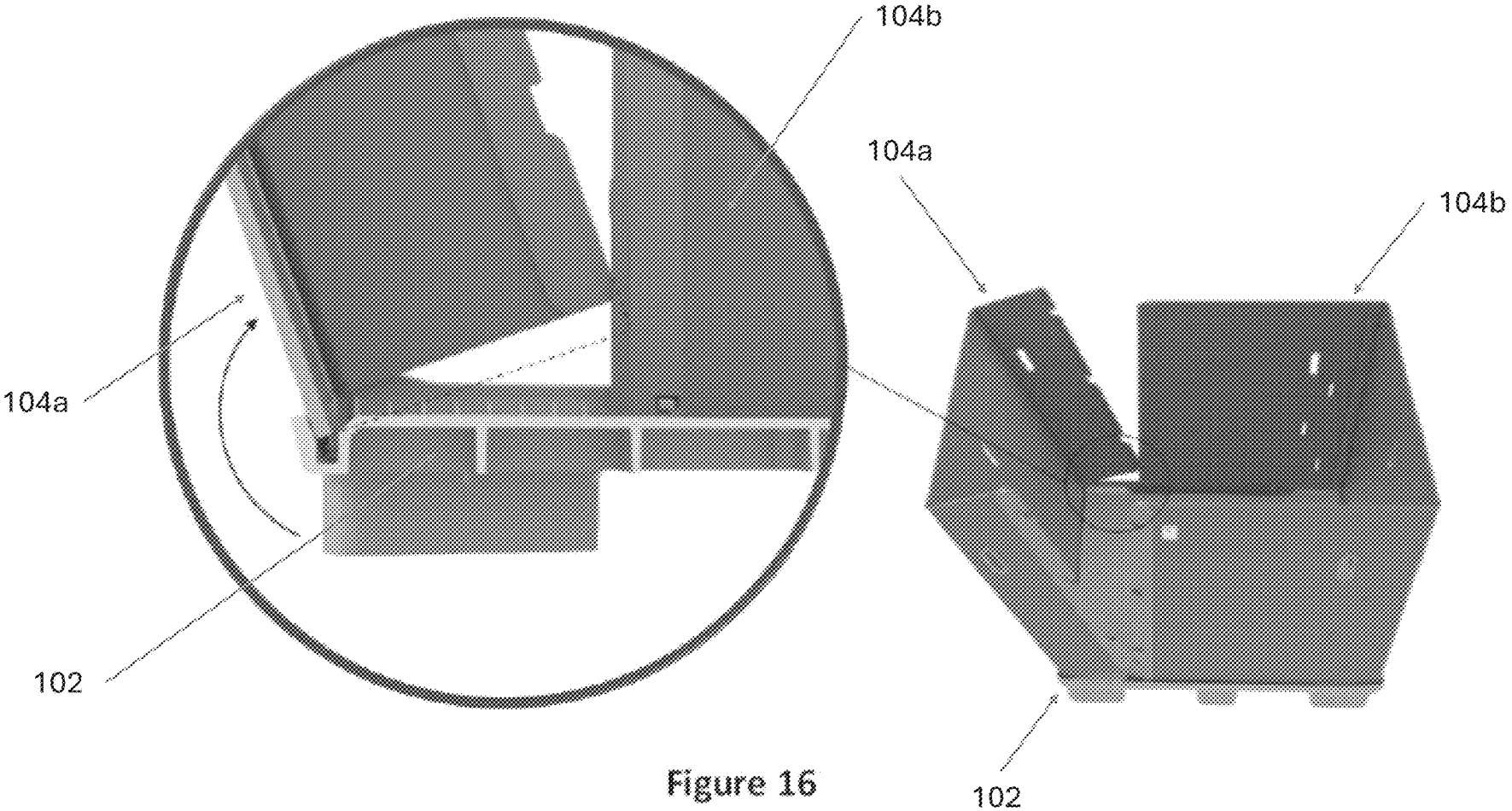
FIG. 16 is a schematic illustration of another exemplary part of the exemplary method of mounting the transport system, according to some embodiments of the invention.
Figure 17:
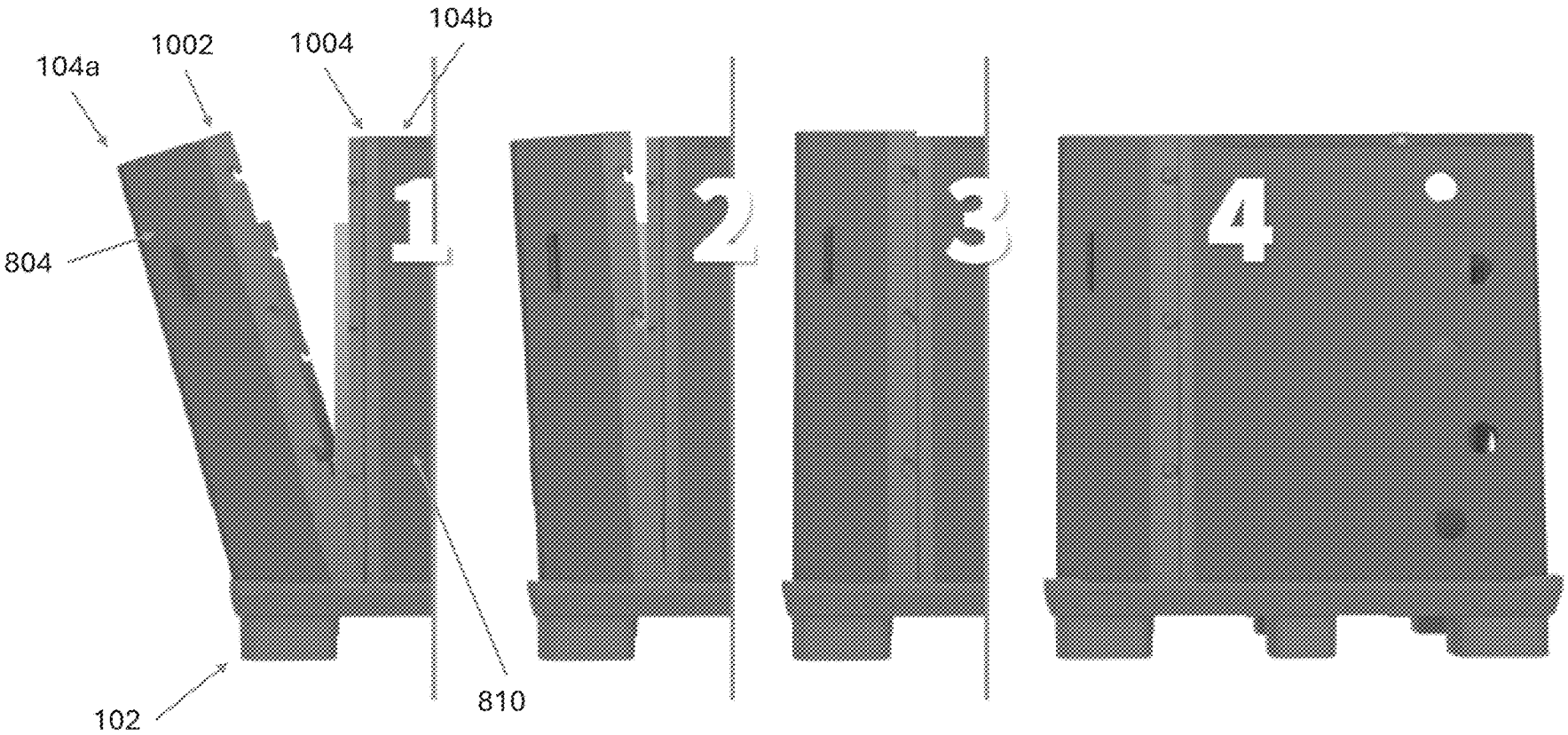
FIG. 17 is a schematic illustration of a plurality of exemplary parts of the exemplary method of mounting the transport system, according to some embodiments of the invention.

4. The user places the extension 902 of the front surface 802 of the front sleeve 104*a* in the only free groove 604 left of the base 102 (1108), optionally while holding the front sleeve 104*a* in an angle as shown in FIGS. 16 and 17. A potential advantage of holding the front sleeve 104*a* at an angle is that it allows an easy insertion of the sleeve in place without applying unnecessary forces and/or pressure on the sleeve. In some embodiments, taking out the sleeve is done the same way, first the user moves the sleeve backwards to provide an angle to the sleeve in relation to the base, and then the user takes out the sleeve from the base, as will be further disclosed below.

5. The user straights the front sleeve so front right side surface 804 and front left side surface 806 rest on the surface of the base 102 (1110), while inserting the male parts of the reversible holding mechanism located in the back sleeve into the female parts of the reversible holding mechanism located in the front sleeve, as shown for example in FIGS. 13*a* and 17.

6. The user pushes down the front sleeve 104*a* to interlock between the parts of the reversible holding mechanism (1112).

Figure 18:
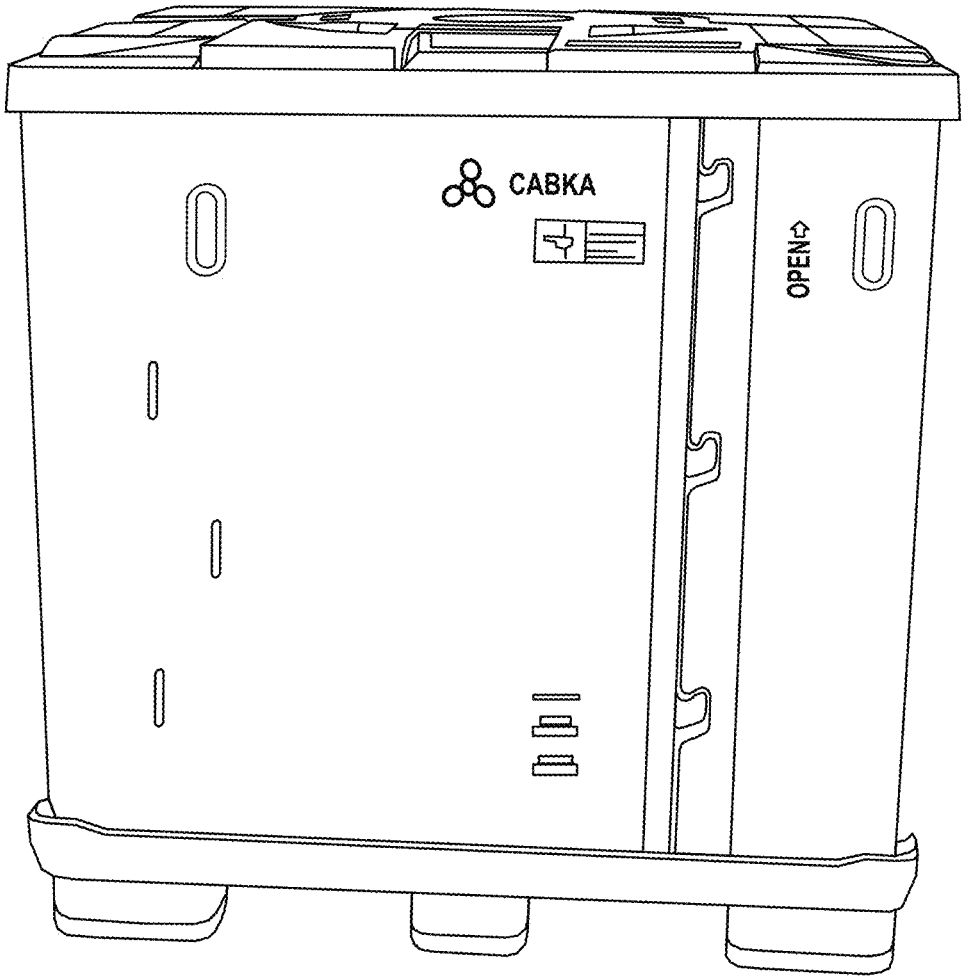
FIG. 18 is a picture of an exemplary transport system at the end of the exemplary method of mounting, according to some embodiments of the invention.

7. The user mounts the cover (1114), as shown for example in FIGS. 1*b*, 3*d* and 18.

FIG. 17 shows exemplary step by step images of the actions performed to mount the front sleeve, according to some embodiments of the invention.

Exemplary Optional Features

Figure 20:
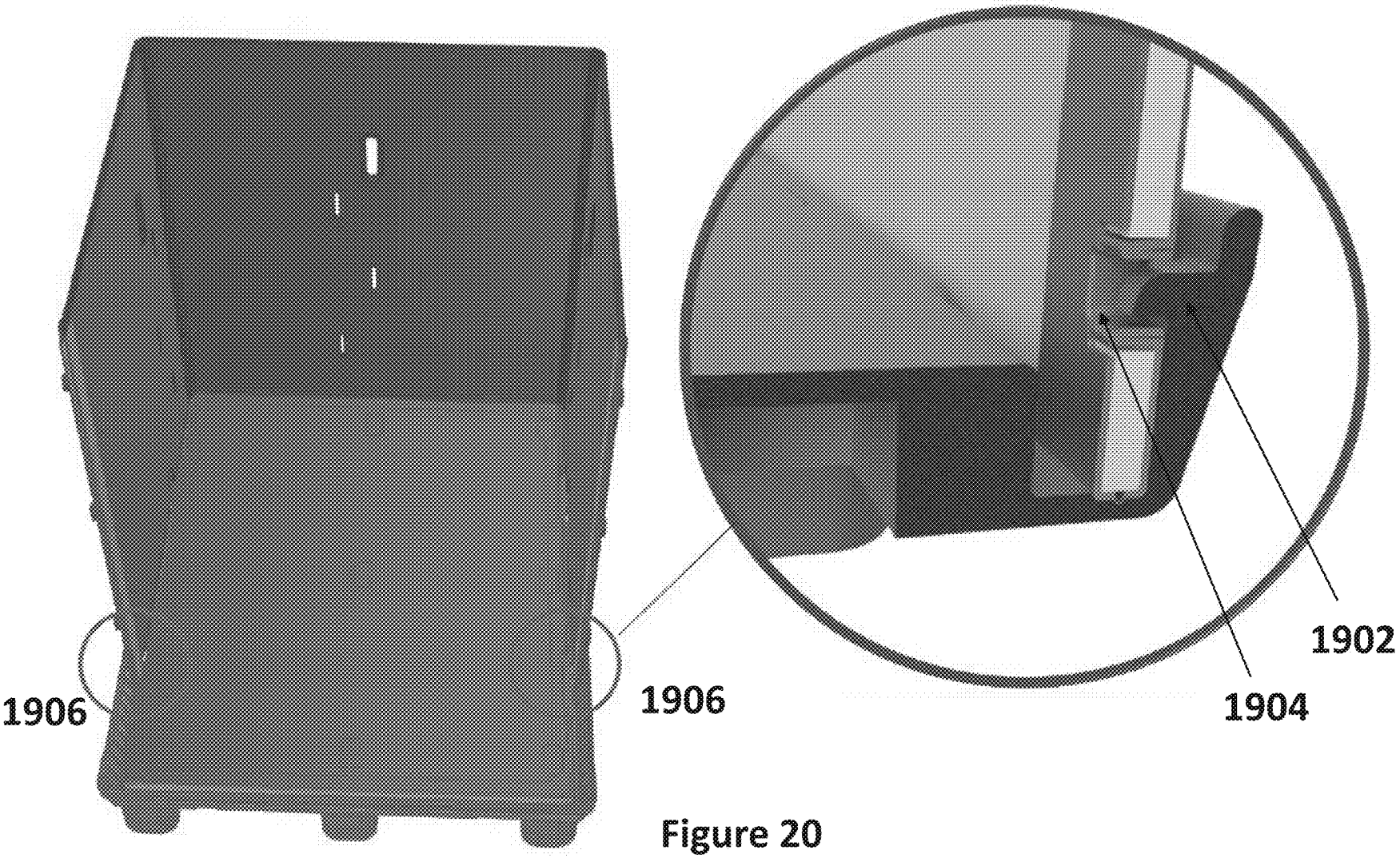
FIG. 20 is a schematic illustration of exemplary optional holder between the base and the sleeve, according to some embodiments of the invention.

In some embodiments, the system comprises an optional holder between the base 102 and the sleeve, as shown for example in FIG. 20. In some embodiments, the optional holder 1902 snaps-in in an orifice 1904 located in the sleeve. In some embodiments, one or more optional holders are added to the system. In FIG. 20, there optional holders in two locations 1906.

Figure 21A:
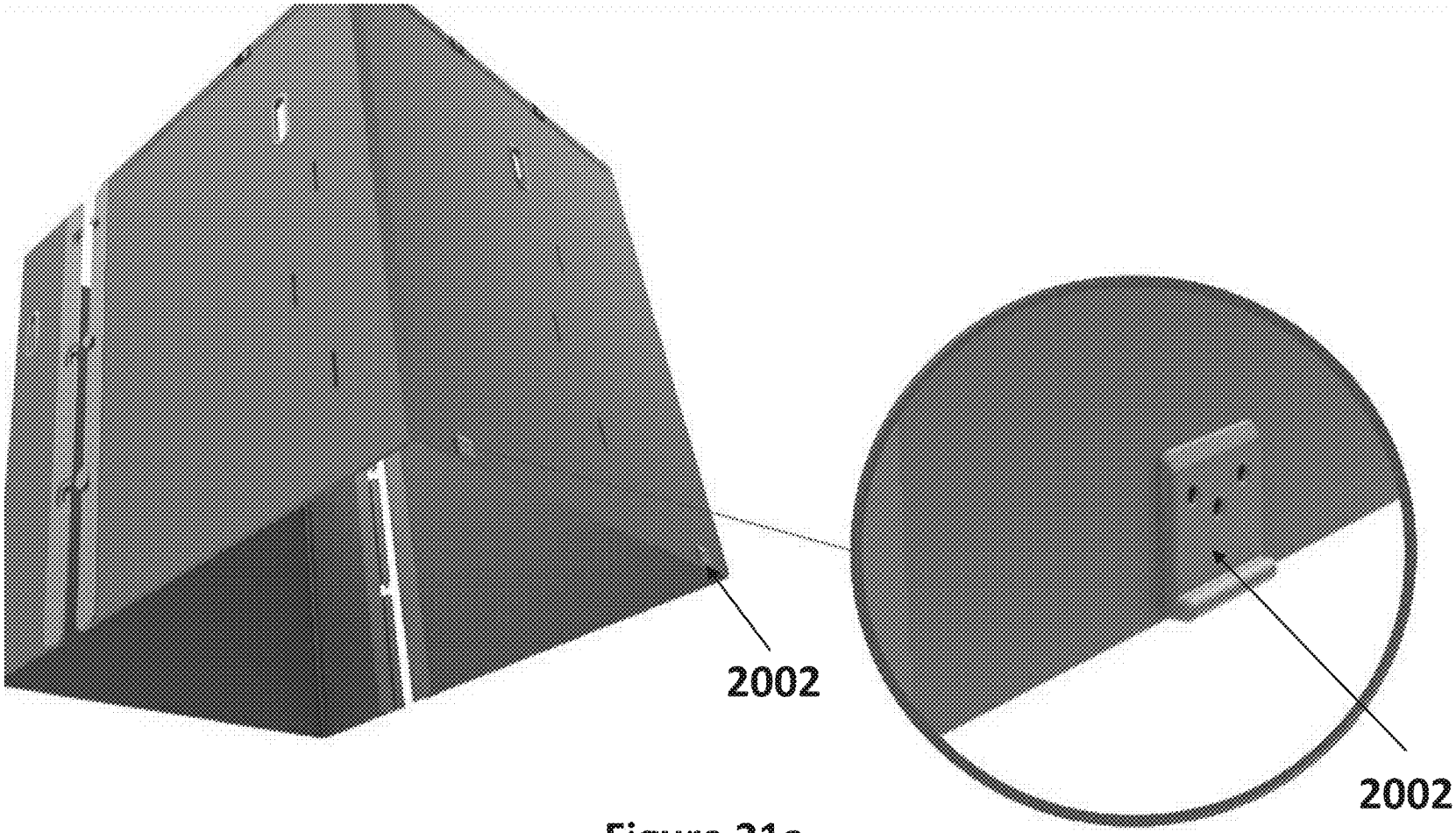
FIGS. 21*a-c* are schematic illustrations of exemplary optional clips, according to some embodiments of the invention.
Figure 21C:
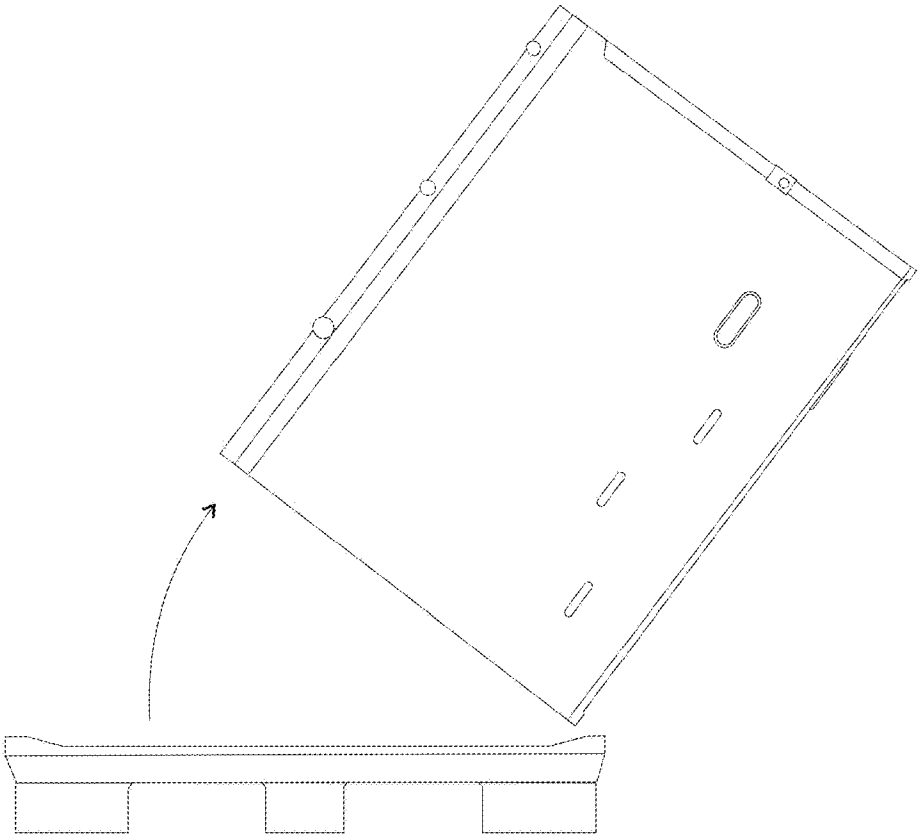
Figure 21B:
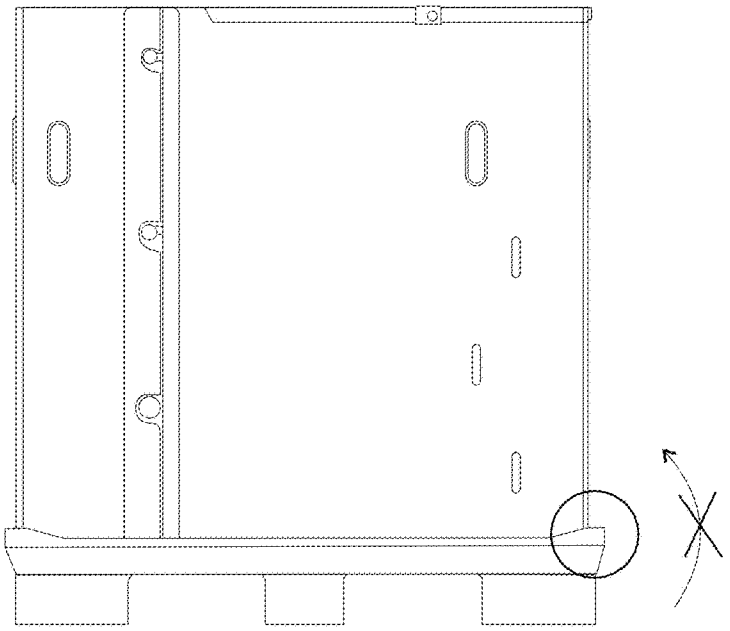

In some embodiments, the back sleeve comprises one or more optional clips 2002, as shown for example in FIGS. 21*a-c*, adapted to engage the base and perform two actions: a. further secure the sleeve to the base, as schematically shown for example in FIG. 21*b*, and provide easy releasing of the sleeve from the base, as schematically shown for example in FIG. 21*c*. In some embodiments, to assemble and disassemble a sleeve pack, there are two options to retain (i.e., lock) the bottom portion of the sleeve to the base and the top portion of the sleeve to the cover. In some embodiments, these include: (1) a passive interference fit, and (2) an active latching mechanism (for example the optional clip). In some embodiments, the passive interference fit lock generally creates an engagement between the reusable sleeve and base and cover. In some embodiments, the active latching mechanism (the optional clip) locks them in place.

Figure 22:
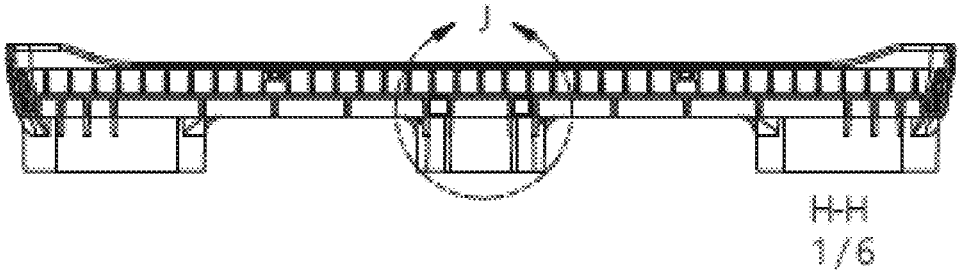
FIG. 22 is a schematic illustration of exemplary optional steel tubes and/or rods to reinforce the base, according to some embodiments of the invention.
Figure 22:
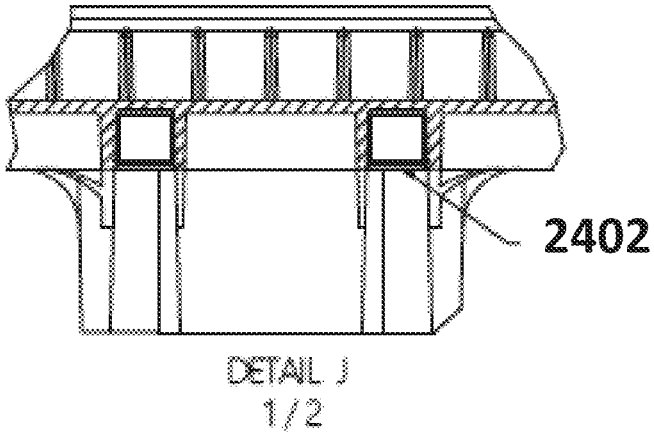
Figure 23A:
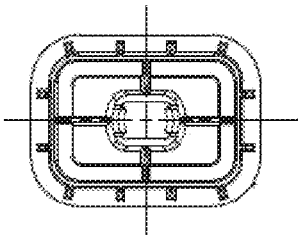
FIGS. 23*a-j* are schematic illustrations of exemplary elevating feet, according to some embodiments of the invention.
Figure 23B:
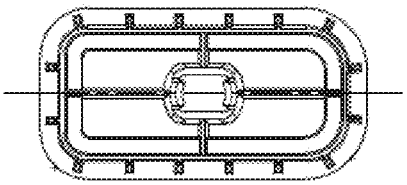
Figure 23C:
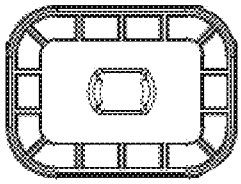
Figure 23D:
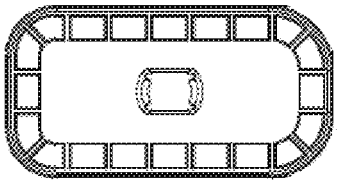
Figure 23E:
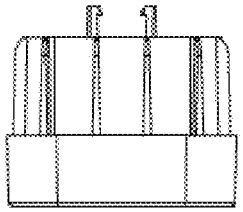
Figure 23F:
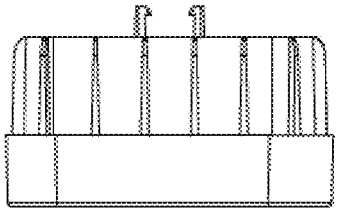
Figure 23G:
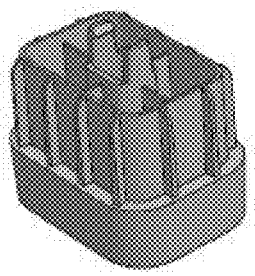
Figure 23H:
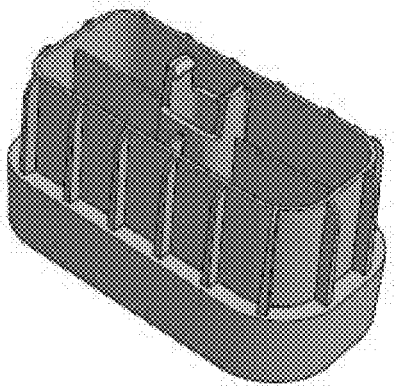
Figure 23I:
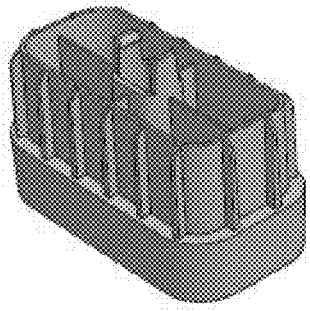
Figure 23J:
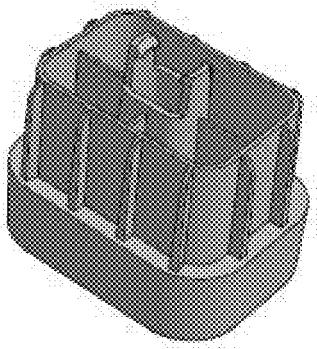

In some embodiments, the base 102 optionally comprises one or more steel tubes and/or rods 2402 to reinforce the base 102, as schematically shown in FIG. 22.

In some embodiments, the base 102 comprises one or more elevating feet 2502 configured to be inserted on dedicated places 2504 (in FIG. 4*c* for example) the bottom surface of the base 102, as also shown for example in FIGS. 1*b* and 3*e*.

In some embodiments, the elevating feet 2502 are as shown for example in FIGS. 23*a-j*. It should be understood that these images are exemplary images only, provided to allow a person having skills in the art to reproduce the invention. Other elevating feet could be used and should be understood that those are also meant to be included in scope of the invention.

In some embodiments, as mentioned before, the transport system 100 is configured to be stackable on top one another, as shown for example in FIGS. 24*a* and 24*b*. In some embodiments, the transport system 100 is configured to be stackable on top one another in either the fully deployed configuration (FIG. 24*a*) or in the folded configuration (FIG. 24*b*).

Figure 25B:
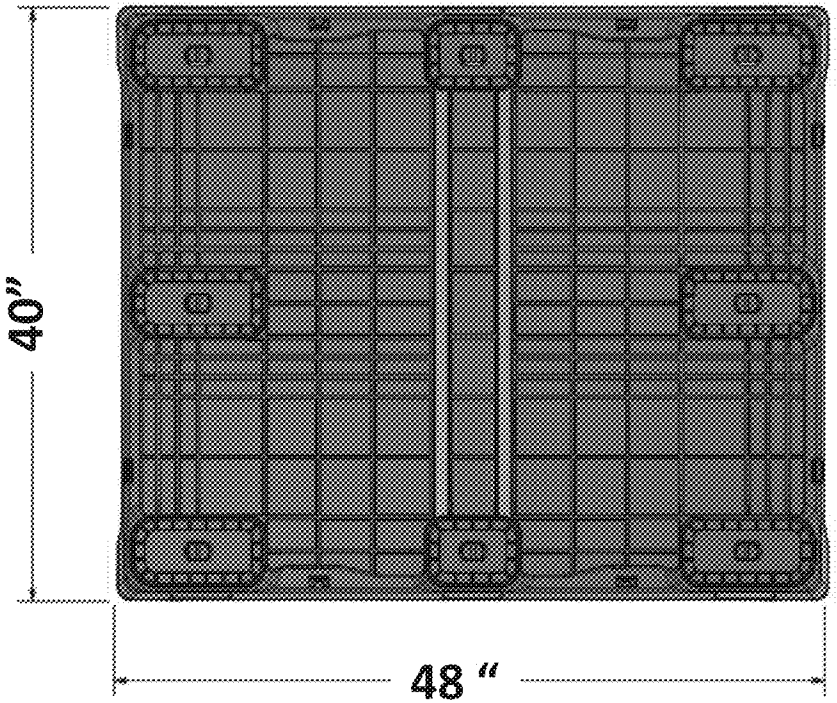
FIGS. 25*a-b* are schematic illustration showing exemplary measurements of an exemplary transport system, according to some embodiments of the invention.
Figure 25A:
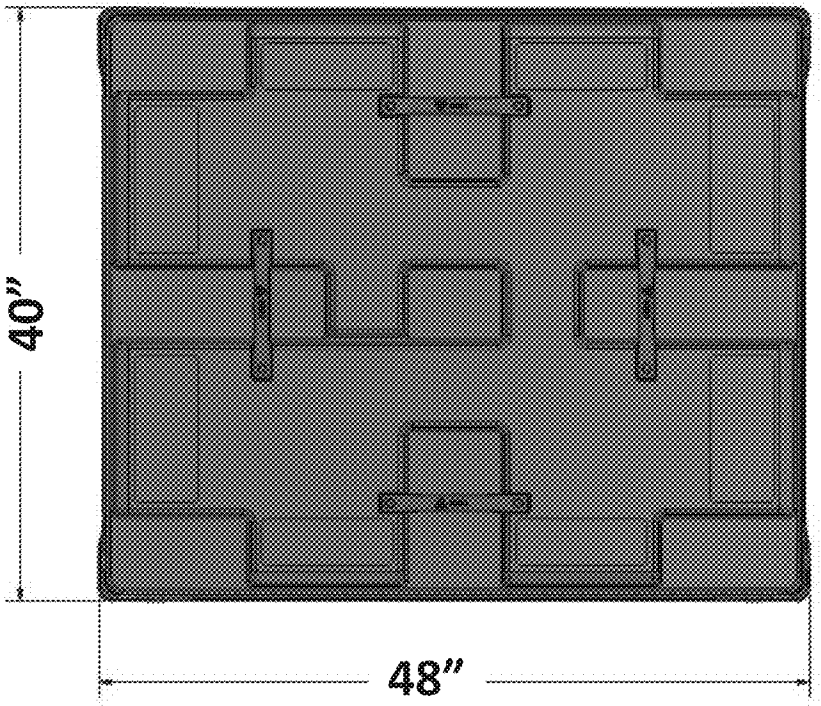

In some embodiments, the transport system 100 comprises exemplary measurements as shown for example in FIGS. 25*a-b*. It should be understood that these measures are exemplary measures only, provided to allow a person having skills in the art to reproduce the invention. Other measures could be used and should be understood that those are also meant to be included in scope of the invention.

It is expected that during the life of a patent maturing from this application many relevant transport systems comprising bases, sleeves and covers will be developed; the scope of the terms base, sleeve, cover, groove, extensions are intended to include all such new technologies a priori.

As used herein with reference to quantity or value, the term "about" means "within ±20% of".

The terms "comprises", "comprising", "includes", "including", "has", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular forms "a", "an" and "the" include plural references unless the context clearly dictates otherwise. For example, the term "a compound" or "at least one compound" may include a plurality of compounds, including mixtures thereof.

Throughout this application, embodiments of this invention may be presented with reference to a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as "from 1 to 6" should be considered to have specifically disclosed subranges such as "from 1 to 3", "from 1 to 4", "from 1 to 5", "from 2 to 4", "from 2 to 6", "from 3 to 6", etc.; as well as individual numbers within that range, for example, 1, 2, 3, 4, 5, and 6. This applies regardless of the breadth of the range.

Whenever a numerical range is indicated herein (for example "10-15", "10 to 15", or any pair of numbers linked by these another such range indication), it is meant to include any number (fractional or integral) within the indicated range limits, including the range limits, unless the context clearly dictates otherwise. The phrases "range/ranging/ranges between" a first indicate number and a second indicate number and "range/ranging/ranges from" a first indicate number "to", "up to", "until" or "through" (or another such range-indicating term) a second indicate number are used herein interchangeably and are meant to include the first and second indicated numbers and all the fractional and integral numbers therebetween.

Unless otherwise indicated, numbers used herein and any number ranges based thereon are approximations within the accuracy of reasonable measurement and rounding errors as understood by persons skilled in the art.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

It is the intent of the applicant(s) that all publications, patents and patent applications referred to in this specification are to be incorporated in their entirety by reference into the specification, as if each individual publication, patent or patent application was specifically and individually noted when referenced that it is to be incorporated herein by reference. In addition, citation or identification of any reference in this application shall not be construed as an admission that such reference is available as prior art to the present invention. To the extent that section headings are used, they should not be construed as necessarily limiting. In addition, any priority document(s) of this application is/are hereby incorporated herein by reference in its/their entirety.

What is claimed is:

1. A collapsible container, comprising:

a. a base comprising:
- i. a back side,
- ii. a front side,
- iii. a left side,
- iv. a right side and
- v. a top surface, said top surface comprising:
- vi. a back groove located along a whole length of a perimeter of said back side,
- vii. a front groove located along a whole length of a perimeter of said front side,
- viii. at least one left groove located at the perimeter of said left side and
- ix. at least one right groove located at the perimeter of said right side;

b. a first sleeve having a first set of three flat surfaces:
- x. a back central flat surface as long as said back side of said base,
- xi. a back left side flat surface partially extending along said left side of said base and
- xii. a back right side flat surface partially extending along said right side of said base;

said back central flat surface comprising a first flat surface extension at a bottom of said back central flat surface; said first flat surface extension adapted to be inserted in said back groove located at said back side of said top surface;

said back left flat surface comprising a second flat surface extension at a bottom of said back left flat surface; said second flat surface extension adapted to be inserted in said at least one left groove located at said left side of said top surface, said second flat surface extension being shorter in length than a total length of said bottom of said back left flat surface;

said back right flat surface comprising a third flat surface extension at a bottom of said back right flat surface; said third flat surface extension adapted to be inserted in said at least one right groove located at said right side of said top surface, said third flat surface extension being shorter in length than a total length of said bottom of said back right flat surface;

c. a second sleeve having a second set of three flat surfaces;
- xiii. a front central flat surface as long as said front side of said base,
- xiv. a front left side flat surface partially extending along said left side of said base and xv. a front right side flat surface partially extending along said right side of said base;

said front central flat surface comprising a second flat surface extension at a bottom of said front central flat surface; said second flat surface extension adapted to be inserted in said front groove located at said front side of said top surface;

wherein said front left side flat surface does not comprise a flat surface extension at a bottom of said front left side flat surface and said front right side flat surface does not comprise a flat surface extension at a bottom of said front right side flat surface;

wherein said at least one left groove and said at least one right groove do not reach said back groove or said front groove;

wherein said back right flat surface is wider than said front right flat surface and said back left flat surface is wider than said left right flat surface;

wherein when said first sleeve and said second sleeve are located in their respective grooves, they completely surround said base.

2. The collapsible container according to claim 1, further comprising a cover.

3. The collapsible container according to claim 1, further comprising a reversible holder for holding said first sleeve and said second sleeve together.

4. The collapsible container according to claim 1, wherein components of said collapsible container are made of recycled materials.

5. The collapsible container according to claim 1, wherein said first sleeve and said second sleeve collapse to a folded configuration, and in said folded configuration the size of said sleeves is smaller than the size of the surface of said base.

6. The collapsible container according to claim 1, wherein said base further comprises metal inserts within said base.

7. The collapsible container according to claim 2, wherein said base comprises one or more elements at the bottom surface of said base for connecting one or more extension legs.

8. The collapsible container according to claim 7, wherein said cover comprises one or more indentations for receiving said one or more extension legs when more than one collapsible container is positioned on top one another.

9. The collapsible container according to claim 1, wherein said base comprises a flap on a periphery of said back side, said front side, said left side and said right side of said top surface, said flap extending upwards from said top surface.

10. The collapsible container according to claim 9, wherein said flap holds said first sleeve and said second sleeve in place.

11. The collapsible container according to claim 1, wherein said base does not comprise angled grooves in corners of said base.

12. The collapsible container according to claim 1, wherein said back groove, said front groove, said at least one left groove and said at least one right groove comprise an inward tapering on at least a part of the external side said groves.

13. The collapsible container according to claim 1, wherein said first set of three flat surfaces of said first sleeve generate a first C-shape sleeve; and wherein said second set of three flat surfaces of said second sleeve generate a second C-shape sleeve; and wherein said first C-shape sleeve is bigger than said second C-shape sleeve.

14. The collapsible container according to claim 1, wherein said front right side surface and said back right side surface are configured to cover the entire perimeter of the right side of the base; and wherein said front left side surface and said back left side surface are configured to cover the entire perimeter of the left side of the base.

15. The collapsible container according to claim 1, wherein at least one of the following is true:

a. said front right side surface and said back right side surface comprise an overlapping area between them;

b. said front left side surface and said back left side surface comprise an overlapping area between them.

16. The collapsible container according to claim 3, wherein said reversible holder comprise at least two parts, one part of said two parts located in said first sleeve and another part of said of said two parts located in said second sleeve.

17. The collapsible container according to claim 3, wherein said collapsible container comprises at least two reversible holders.

18. The collapsible container according to claim 1, further comprising one or more additional holder elements in said base and one or more dedicated orifices in said first sleeve and/or said second sleeve for allowing insertion of said one or more additional holder elements therein.

19. The collapsible container according to claim 18, wherein at least one of the following is true:

a. said one or more additional holder engages said one or more dedicated orifices passively; and b. said one or more additional holder actively engages said one or more dedicated orifices by a user.

20. The collapsible container according to claim 1, further comprising one or more reinforcement inserts in said base; and wherein said reinforcement inserts are made of steel.

* * * * *